US010661557B2

(12) United States Patent
Kashimura

(10) Patent No.: US 10,661,557 B2
(45) Date of Patent: May 26, 2020

(54) LIQUID DISCHARGE APPARATUS FOR PERFORMING PRINTING

(71) Applicant: Seiko Epson Corporation, Tokyo (JP)

(72) Inventor: Toru Kashimura, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/260,793

(22) Filed: Jan. 29, 2019

(65) Prior Publication Data

US 2019/0232642 A1 Aug. 1, 2019

(30) Foreign Application Priority Data

Jan. 31, 2018 (JP) ..... 2018-015774

(51) Int. Cl.
*B41J 2/045* (2006.01)
*B41J 2/14* (2006.01)

(52) U.S. Cl.
CPC ..... *B41J 2/04505* (2013.01); *B41J 2/0452* (2013.01); *B41J 2/0455* (2013.01); *B41J 2/04515* (2013.01); *B41J 2/04541* (2013.01); *B41J 2/04581* (2013.01); *B41J 2/04588* (2013.01); *B41J 2/04593* (2013.01); *B41J 2/04596* (2013.01); *B41J 2/14233* (2013.01);
(Continued)

(58) Field of Classification Search
CPC ..... B41J 2/04505; B41J 2/04581; B41J 2/04541; B41J 2/14233; B41J 2/04596; B41J 2/04593; B41J 2/04588; B41J 2/0455; B41J 2/0452; B41J 2/04515; B41J 2002/14419; B41J 2002/14362; B41J 2002/14241
See application file for complete search history.

(56) References Cited

U.S. PATENT DOCUMENTS

2003/0025744 A1 2/2003 Nou
2004/0183842 A1* 9/2004 Kobayashi ..... B41J 2/04551 347/10

(Continued)

FOREIGN PATENT DOCUMENTS

EP 3 067 206 A1 9/2016
JP 2017-149071 A 8/2017

(Continued)

OTHER PUBLICATIONS

Extended European Search Report for Application No. EP 19 15 4924 dated Jun. 4, 2019 (8 pages).

*Primary Examiner* — Bradley W Thies
(74) *Attorney, Agent, or Firm* — Harness, Dickey & Pierce, P.L.C.

(57) ABSTRACT

A liquid discharge apparatus includes: a signal line supplied with a print data signal including first data and second data; a discharge head including a plurality of nozzles including a first nozzle and a second nozzle that discharge liquid in accordance with the print data signal; a first register that is connected to the signal line, captures the first data corresponding to the first nozzle, and holds the first data; a second register that is connected to the signal line, captures the second data corresponding to the second nozzle, and holds the second data; and a register selection circuit that exclusively selects either capturing the first data by the first register or capturing the second data by the second register based on register selection data.

6 Claims, 14 Drawing Sheets

(52) U.S. Cl.
CPC ..... *B41J 2002/14241* (2013.01); *B41J 2002/14362* (2013.01); *B41J 2002/14419* (2013.01)

(56) References Cited

U.S. PATENT DOCUMENTS

| | | | | |
|---|---|---|---|---|
| 2004/0223016 | A1* | 11/2004 | Koyama | B41J 2/04541 347/12 |
| 2006/0061608 | A1* | 3/2006 | Nakayama | B41J 2/04573 347/10 |
| 2010/0097114 | A1* | 4/2010 | Miyazaki | H03K 7/08 327/176 |
| 2016/0107439 | A1 | 4/2016 | Mogami | |
| 2017/0246862 | A1 | 8/2017 | Abe | |

FOREIGN PATENT DOCUMENTS

| | | | |
|---|---|---|---|
| TW | 201722743 | A | 7/2017 |
| WO | WO-2017-094609 | A1 | 6/2017 |
| WO | WO-2017-094610 | A1 | 6/2017 |

* cited by examiner

| | | LARGE DOT | MEDIUM DOT | SMALL DOT | MICRO VIBRATION |
|---|---|---|---|---|---|
| [SIH, SIL] | | [1, 1] | [1, 0] | [0, 1] | [0, 0] |
| S | T1 | H | H | L | L |
| | T2 | H | L | H | L |
| | T3 | L | L | L | H |

| THE NUMBER OF TRANSFER BITS [bit] | THE NUMBER OF CHARGING AND DISCHARGING TIMES [TEN THOUSAND TIMES] | |
|---|---|---|
| | SHIFT REGISTER | SERIAL-TO-PARALLEL CONVERSION CIRCUIT 220 |
| 10 | 0.15 | 0.08 |
| 100 | 14.08 | 6.24 |
| 500 | 350.40 | 151.20 |
| 1000 | 1400.80 | 602.40 |

| THE NUMBER OF TRANSFER BITS [bit] | THE NUMBER OF OCCURRENCES OF THROUGH CURRENT [TEN THOUSAND TIMES] | |
|---|---|---|
| | SHIFT REGISTER | SERIAL-TO-PARALLEL CONVERSION CIRCUIT (20) |
| 10 | 0.03 | 0.01 |
| 100 | 3.03 | 0.09 |
| 500 | 75.15 | 0.45 |
| 1000 | 300.30 | 0.90 |

LIQUID DISCHARGE APPARATUS FOR PERFORMING PRINTING

The entire disclosure of Japanese Patent Application No. 2018-015774, filed Jan. 31, 2018 is expressly incorporated by reference herein.

BACKGROUND

1. Technical Field

The present invention relates to a liquid discharge apparatus.

2. Related Art

For an ink jet printer (liquid discharge apparatus) that prints an image or a document by discharging liquid, such as ink, or the like, for example, an apparatus using a piezoelectric element, such as a piezo element, or the like is known. In a print head, piezoelectric elements are disposed correspondingly to respective nozzles that discharge ink and cavities that store ink to be discharged from the nozzles. The piezoelectric element is then displaced in accordance with a drive signal so that a vibration plate disposed between the piezoelectric element and the cavity is displaced to change the volume of the cavity. Thereby, a predetermined amount of ink is discharged from a nozzle at predetermined timing to form a dot on a medium. In such a liquid discharge apparatus, a drive signal supplied to a piezoelectric element is controlled by a control signal. Such a control signal is supplied to a print head as a serial signal, and is converted into parallel signals corresponding to the respective nozzles by the print head.

In a liquid discharge apparatus disclosed in JP-A-2017-149071, a print data signal that serially includes data for controlling respective nozzles is supplied to a print head, and a shift register converts the print data signal into parallel signals including the data corresponding to respective nozzles. The supply of drive signals to individual piezoelectric elements is then controlled based on the respective parallel signals so that ink is discharged to form a dot on a medium.

In recent years, the number of nozzles that are operated at one time has been increased in order to increase the print speed in a liquid discharge apparatus. With an increase of the number of nozzles, the number of pieces of data corresponding to each nozzle has been increased, and thus the number of bits of a print data signal has been increased. Accordingly, the number of registers for holding data corresponding to each nozzle is increased.

In a shift register of the liquid discharge apparatus disclosed in JP-A-2017-149071, a print data signal is input into a first-stage register included in the shift register, and data corresponding to each nozzle is transferred to a later-stage register in accordance with a clock signal. In a shift register having such a configuration, when the number of registers included in the shift register is increased, the number of times of transferring the data to a later stage is increased. Accordingly, the number of times of rewriting the register is increased.

Heat generation by a register is caused by charging and discharging of a gate of a transistor, which is accompanied with rewriting the register and a through current. That is to say, with an increase in the number of rewriting a register, heat generation by a shift register increases. Heat generated by such a shift register is imposed on ink so that there is a possibility that the viscosity of the ink, and the like is changed, and thus a problem arises that the discharge precision of the liquid discharge apparatus might deteriorate.

SUMMARY

According to an aspect of the invention, there is provided a liquid discharge apparatus. The liquid discharge apparatus includes: a signal line supplied with a print data signal including first data and second data; a discharge head including a plurality of nozzles including a first nozzle and a second nozzle that discharge liquid in accordance with the print data signal; a first register that is connected to the signal line, captures the first data corresponding to the first nozzle, and holds the first data; a second register that is connected to the signal line, captures the second data corresponding to the second nozzle, and holds the second data; and a register selection circuit that exclusively selects either capturing the first data by the first register or capturing the second data by the second register based on register selection data.

In the liquid discharge apparatus according to the above-described aspect, the register selection circuit may include a third register and a fourth register, and a shift register that transfers the register selection data, and when the register selection data is held in the third register, the first register may capture the first data, and when the register selection data is held in the fourth register, the second register may capture the second data.

In the liquid discharge apparatus according to the above-described aspect, when supply of the print data signal is stopped, the register selection data may be set to be input to the shift register.

In the liquid discharge apparatus according to the above-described aspect, when supply of the print data signal is stopped, data held in the third register and the fourth register may be reset by a reset signal.

In the liquid discharge apparatus according to the above-described aspect, the plurality of nozzles may be disposed at a density of 300 pieces or more per inch, and a number of the nozzles may be 600 or more.

In the liquid discharge apparatus according to the above-described aspect, the discharge head may include a piezoelectric element that causes the plurality of nozzles to discharge the liquid based on the print data signal, an integrated circuit that includes the first register, the second register, and the register selection circuit, and a protection substrate disposed between the piezoelectric element and the integrated circuit, wherein the protection substrate may form a protection space that protects the piezoelectric element.

BRIEF DESCRIPTION OF THE DRAWINGS

The invention will be described with reference to the accompanying drawings, wherein like numbers reference like elements.

DESCRIPTION OF EXEMPLARY EMBODIMENTS

In the following, descriptions will be given of preferred embodiments of the invention with reference to the drawings. The drawings are for convenience of the descriptions. In this regard, the embodiments described below will not unduly limit the contents of the invention described in the claims. Also, all of the components described below are not necessarily essential requirements for the invention.

In the following, a description will be given of a liquid discharge apparatus according to the invention by taking an ink jet printer, which is a printer that discharges ink as a liquid.

In this regard, as a liquid discharge apparatus, in addition to a printer, it is possible to give examples, for example, a color material discharge apparatus for use in manufacturing a color filter of a liquid crystal display, and the like, an electrode material discharge apparatus for use in forming an electrode of an organic EL display, a surface light emitting display, and the like, and a bioorganic matter discharge apparatus for use in manufacturing a biochip, and the like.

1. First Embodiment

1.1 Configuration of Liquid Discharge Apparatus

Figure 1:
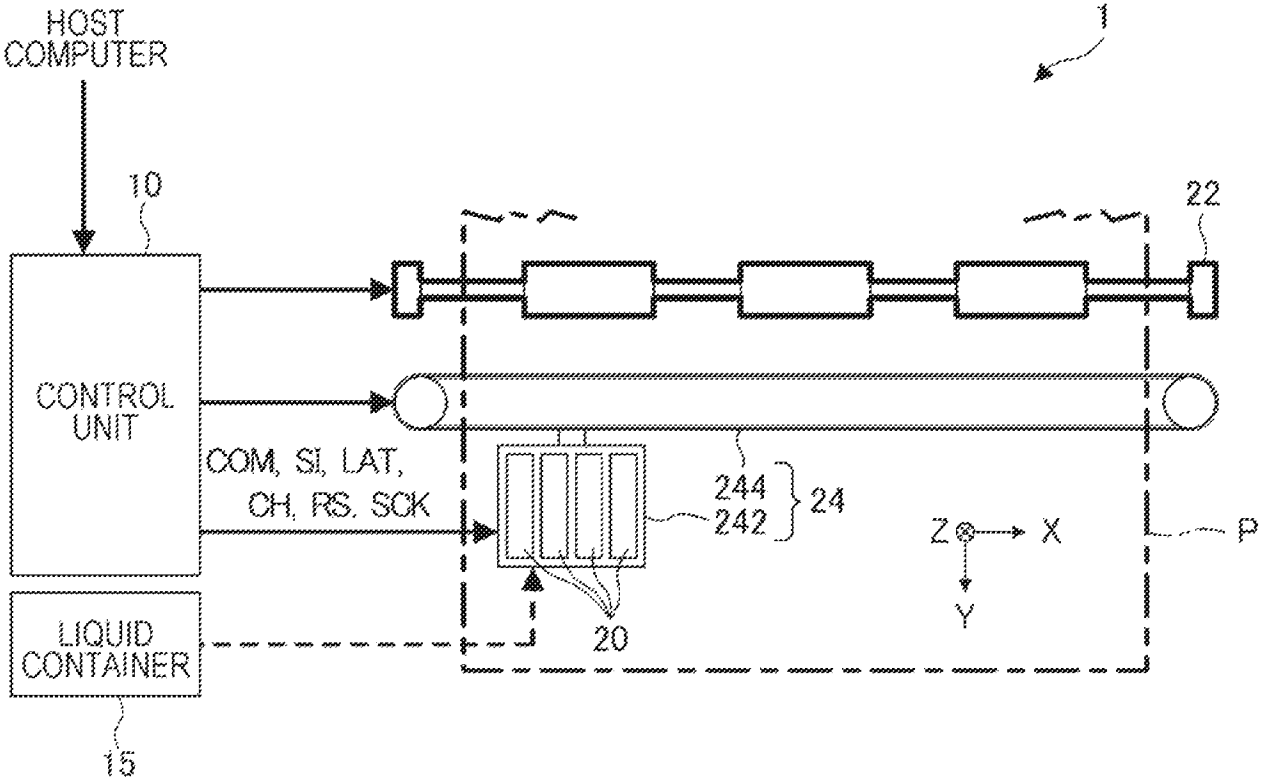
FIG. 1 is a configuration diagram illustrating a liquid discharge apparatus.

FIG. 1 is a configuration diagram illustrating a liquid discharge apparatus 1 according to a first embodiment. As illustrated in FIG. 1, the liquid discharge apparatus 1 performs printing by discharging ink, which is an example of liquid, onto a medium P to form a dot. The medium P is typically a printing paper, but may be any printing target, such as a resin film, textile, or the like.

The liquid discharge apparatus 1 includes a liquid container 15, a control unit 10, a transport unit 22, a movement unit 24, and a plurality of discharge heads 20.

The liquid container 15 stores ink to be discharged onto the medium P. For the liquid container 15, for example, a detachable cartridge from the liquid discharge apparatus 1, a pouched ink pack formed by a flexible film, a refillable tank ink, or the like is used.

The control unit 10 includes, for example, a processing circuit, such as a CPU (Central Processing Unit), FPGA (Field Programmable Gate Array), or the like and a storage circuit, such as a semiconductor memory, or the like. The control unit 10 controls each component of the liquid discharge apparatus 1 in accordance with a signal input from an external device, such as a host computer, or the like.

The transport unit 22 transports the medium P under the control of the control unit 10. In this regard, hereinafter the direction in which the medium P is transported is assumed to be a Y-axis direction.

The movement unit 24 includes a carriage 242 and an endless belt 244.

The carriage 242 is mounted with a plurality of discharge heads 20. Also, the carriage 242 is fixed to the endless belt 244.

The movement unit 24 drives the endless belt 244 under the control of the control unit 10 to reciprocate the carriage 242 mounted with a plurality of discharge heads 20 along an X-axis direction. In this regard, the X-axis direction is a direction intersecting the Y-axis direction.

Each discharge head 20 is supplied with ink from the liquid container 15. Also, each discharge head 20 receives input of a drive signal COM, a print data signal SI, a latch signal LAT, a change signal CH, a register selection signal RS, and a clock signal SCK from the control unit 10.

Each discharge head 20 selects the voltage waveform of the drive signal COM in accordance with the input signal and discharges ink in accordance with the selected drive signal COM along a Z-axis direction.

At this time, the carriage 242 mounted with each discharge head 20 is reciprocated simultaneously with the transport of the medium P. Each discharge head 20 then discharges ink at a desired position on the surface of the medium P. Thereby, a dot is formed on the surface of the medium P.

Here, the Z-axis direction is a direction intersecting the X-axis direction and the Y-axis direction. In this regard, in the present embodiment, the X-axis direction, the Y-axis direction, and the Z-axis direction are orthogonal to one another.

1.2 Electrical Configuration of Liquid Discharge Apparatus

Figure 2:
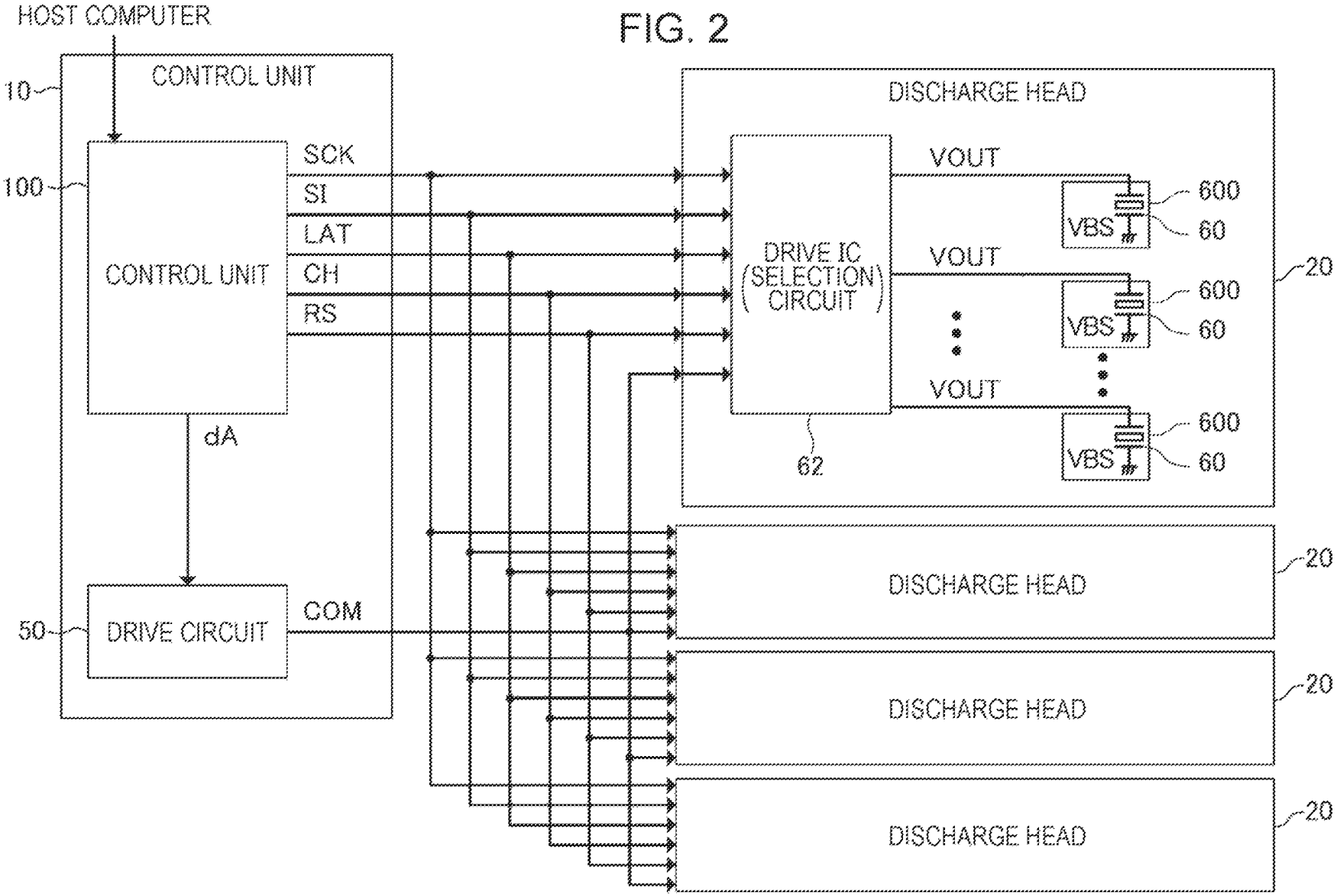
FIG. 2 is an electrical configuration diagram of the liquid discharge apparatus.

FIG. 2 is an electrical configuration diagram of the liquid discharge apparatus 1. The liquid discharge apparatus 1 includes a control unit 10, a plurality of discharge heads 20, and a flexible flat cable (not illustrated). The flexible cable electrically connects the control unit 10 and a plurality of discharge heads 20.

The control unit 10 includes a control circuit 100 and a drive circuit 50. When the control circuit 100 receives various signals of, such as image data, and the like from a host computer, the control circuit 100 outputs various control signals, and the like for controlling each section.

Specifically, the control circuit 100 supplies the print data signal SI, the latch signal LAT, the change signal CH, the register selection signal RS, and the clock signal SCK to the discharge heads 20. Also, the control circuit 100 supplies data dA that specifies the waveform of the drive signal COM to the drive circuit 50.

The drive circuit 50 generates the drive signal COM in accordance with the data dA. Specifically, the drive circuit 50 performs digital-to-analog conversion on the supplied data dA and then performs Class D amplification to generate the drive signal COM.

A detailed description will be given of each of the plurality of discharge heads 20. Each of the plurality of discharge heads 20 discharges ink in accordance with the drive signal COM, the print data signal SI, the latch signal LAT, the change signal CH, the register selection signal RS, and the clock signal SCK that are supplied from the control unit 10. In this regard, a description will be given of the operation of the discharge head 20 later.

The discharge head 20 includes a discharge section 600 and a drive IC 62.

The drive IC 62, which is an integrated circuit, causes a piezoelectric element 60 to change whether to select the voltage waveform of the drive signal COM or not in accordance with the drive signal COM, the print data signal SI, the register selection signal RS, the latch signal LAT, the change signal CH, and the clock signal SCK. Thereby, the discharge section 600 generates a drive signal VOUT to be supplied to the discharge head 20.

Each discharge section 600 includes a plurality of piezoelectric elements 60. The drive signal VOUT supplied to the discharge section 600 is supplied to one end of the piezoelectric element 60. Also, the other end of the piezoelectric element 60 is supplied with a reference voltage signal VBS in common. The piezoelectric element 60 is displaced in accordance with the potential difference between the drive signal VOUT and the reference voltage signal VBS, and ink is discharged from the discharge section 600 by the displacement.

In this regard, each of a plurality of discharge heads 20 has the same configuration. Accordingly, one discharge head 20 is described as a representative in the following description. Also, although four discharge heads 20 are illustrated in FIG. 2, five or more discharge heads 20 may be disposed.

1.3 Structure of Discharge Head

Figure 3:
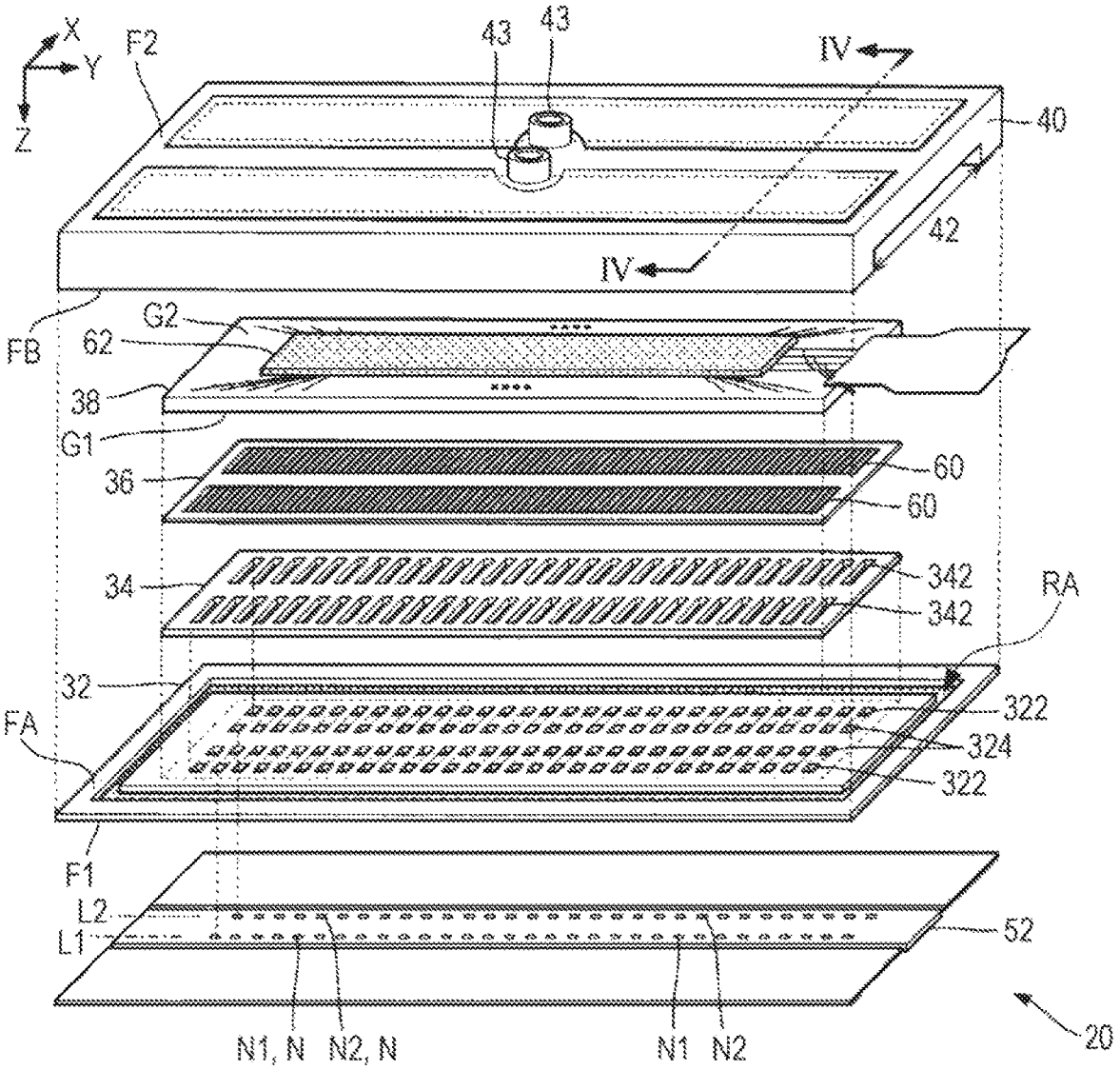
FIG. 3 is an exploded perspective view of a discharge head.

Here, a description will be given of the structure of the discharge head 20. FIG. 3 is an exploded perspective view of the discharge head 20. Also, FIG. 4 is a sectional view taken on line IV-IV of FIG. 3.

Figure 4:
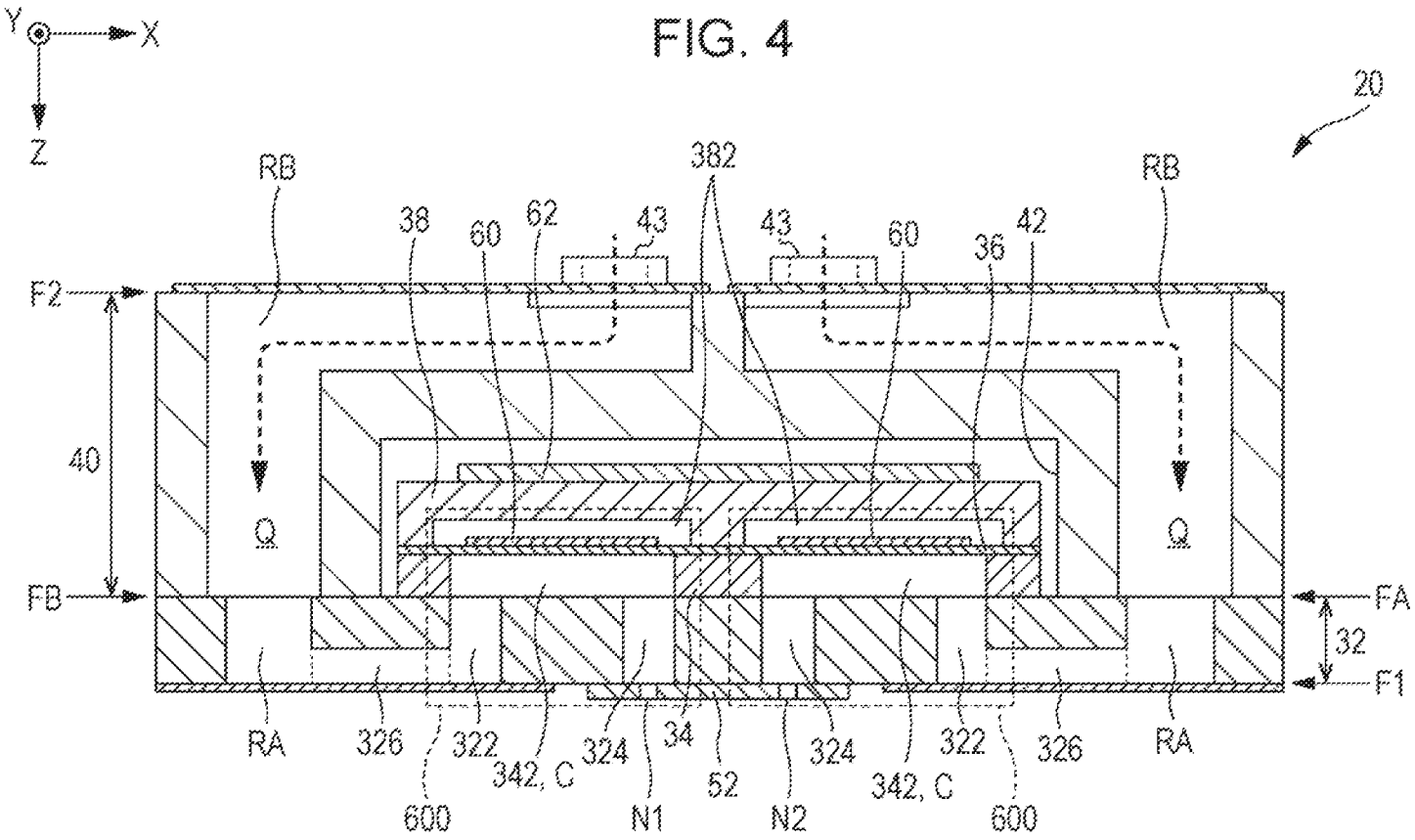
FIG. 4 is a sectional view taken on line IV-IV of FIG. 3.

As illustrated in FIG. 3 and FIG. 4, the discharge head 20 includes a channel substrate 32, a pressure chamber substrate 34, a vibration plate 36, a protection substrate 38, a housing 40, and a nozzle plate 52. Each component of the discharge head 20 is a plate-shaped member which is long in the Y-axis direction. Each component is laminated in the Z-axis direction and is bonded with each other by adhesive, or the like.

Specifically, the channel substrate 32 is a plate-shaped member including a face F1 and a face FA. The face F1 is a surface on the medium P side, and the face FA is a surface on the opposite side of the face F1. On the face FA side of the channel substrate 32, a pressure chamber substrate 34, a vibration plate 36, a protection substrate 38, and a housing 40 are disposed. Also, the nozzle plate 52 is disposed on the face F1 side of the channel substrate 32.

As illustrated in FIG. 3, nozzles N, which are through holes, are formed on the nozzle plate 52. The number of nozzles N disposed on the nozzle plate 52 is 2M, for example.

Specifically, two nozzle rows including a row L1, in which M nozzles N are arranged in the Y-axis direction, and a row L2, in which M nozzles N are arranged in the Y-axis direction, are formed on the nozzle plate 52. Hereinafter each of the nozzles N that belongs to the row L1 is referred to as a nozzle N1, and each of the nozzles N that belongs to the row L2 is referred to as a nozzle N2.

Here, the nozzles N1 and the nozzles N2 are disposed at a density of 300 or more pieces per inch. Further, 600 pieces or more nozzles N are disposed on the nozzle plate 52. In other words, the total number, 2M, of nozzles N disposed on the nozzle plate 52 is 600 or more.

In this regard, in the present embodiment, a description will be given on the assumption that the position of the m-th nozzle N1 in the Y-axis direction among the nozzles N1 substantially matches the position of the m-th nozzle N2 among the nozzle N2. However, the position of the m-th nozzle N1 among the nozzles N1 may differ from the position of the m-th nozzle N2 among the nozzles N2 in the Y-axis direction.

As illustrated in FIG. 3 and FIG. 4, a channel RA, which are channels of ink, are formed on the channel substrate 32. Also, 2M channels 322 and 2M channels 324 that correspond to 2M nozzles N are formed on the channel substrate 32.

As illustrated in FIG. 4, the channels 322 and the channels 324 are openings that are formed so as to pass through the channel substrate 32. Among these, the channels 324 communicate with the corresponding nozzles N. Also, the channels 322 communicate with the channel RA via two channels 326 formed on the face F1 of the channel substrate 32.

As illustrated in FIG. 3 and FIG. 4, 2M openings 342 corresponding to the respective 2M nozzles N are formed on the pressure chamber substrate 34. Also, a vibration plate 36 is disposed on the surface on the opposite side of the pressure chamber substrate 34 from the channel substrate 32.

The vibration plate 36 is a vibratable plate-shaped member, and the vibration plate 36 and the face FA of the channel substrate 32 are opposed to each other at some intervals inside each opening 342. The space positioned between the face FA of the channel substrate 32 and the vibration plate 36 inside the opening 342 functions as a pressure chamber C.

The pressure chamber C is a space having the X-axis direction in a longer side direction and the Y-axis direction in a shorter side direction. On the pressure chamber substrate 34, 2M pressure chambers C are disposed so as to correspond to the respective 2M nozzles N. The pressure chambers C that are disposed correspondingly to the respective nozzles N communicate with the channel RA via the respective channels 322 and the respective channels 326 and communicate with the respective nozzles N via the respective channels 324.

On the face opposite to the pressure chambers C of the vibration plate 36, 2M piezoelectric elements 60 corresponding to the respective pressure chambers C are disposed.

Each of the piezoelectric elements 60 is displaced in accordance with the potential difference between a drive signal VOUT supplied at one end and a reference voltage signal VBS supplied at the other end. The vibration plate 36 vibrates with the displacement of the piezoelectric element 60, and the pressure in the pressure chamber C changes with the vibration. With a change in the pressure in the pressure chamber C, the pressure is applied to the ink filled in the pressure chamber C, and ink is discharged from the nozzle N.

In this regard, as illustrated in FIG. 4, the pressure chamber C, the channels 322 and 324, the nozzle N, the vibration plate 36, and the piezoelectric element 60 function as the discharge section 600 for discharging ink filled in the pressure chamber C by driving the piezoelectric element 60.

As illustrated in FIG. 3 and FIG. 4, the protection substrate 38 is disposed on the surface of the vibration plate 36 or the surface of the pressure chamber substrate 34. The protection substrate 38 protects the 2M piezoelectric elements 60 formed on the vibration plate 36.

Specifically, two concave accommodation spaces 382 are formed on a face G1, which is a surface on the side of the medium P of the protection substrate 38. One of the two accommodation spaces 382 is a space for accommodating M piezoelectric elements 60 corresponding to the M nozzles N1 disposed in the row L1, and the other is a space for accommodating M piezoelectric elements 60 corresponding to the M nozzles N2 disposed in the row L2.

The accommodation space 382 functions as a "protection space" that protects the piezoelectric element 60 from deteriorating by the influence of oxygen, moisture, and the like. Such a protection space may be a space produced by, for example, as illustrated in FIG. 4 protection substrate 38, by sealing the concave accommodation space 382 by the vibration plate 36. Also, if there is an opening partly between the protection substrate 38 and the vibration plate 36, a space sealed by the housing 40 may serve as a protection space.

Also, the accommodation space 382 has a sufficient size in the Z-axis direction such that the piezoelectric element 60 does not contact the protection substrate 38 even if the piezoelectric element 60 is displaced. Thereby, the piezoelectric element 60 is protected from coming into contact with the other component by the displacement of the piezoelectric element 60.

A drive IC 62 is disposed on the face G2, which is the surface on the opposite side of the face G1 of the protection substrate 38. The drive IC 62 has a rectangular shape that has a long side and a short side. The drive IC 62 may be a long rectangular shape having the length of the long side ten times or more the length of the short side.

The housing 40 is a case for storing ink to be supplied to the pressure chamber C. A face FB, which is a surface on the medium P side of the housing 40, is fixed to the face FA of the channel substrate 32. A groove-shaped concave section 42 extending in the Y-axis direction is formed on the face FB, and the protection substrate 38 and the drive IC 62 are accommodated inside the concave section 42.

As illustrated in FIG. 4, a channel RB that communicates with the channel RA is formed on the housing 40. The channel RB and the channel RA disposed on the channel substrate 32 function as a reservoir Q that stores ink to be supplied to the pressure chamber C.

Two inlets 43 for introducing ink supplied from the liquid container 15 to the reservoir Q are disposed on the face F2 which is the surface opposite from the face FB of the housing 40.

1.4 Configurations of Drive Signal COM and Drive Signal VOUT

Next, descriptions will be given of the drive signal COM supplied from the drive circuit 50 and the drive signal VOUT supplied to the piezoelectric element 60 with reference to FIG. 5 and FIG. 6.

Figure 5:
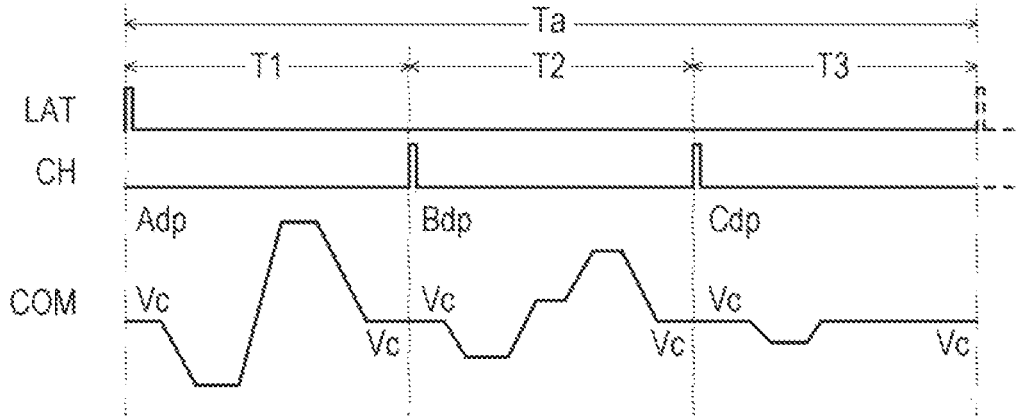
FIG. 5 is a diagram illustrating the waveform of a drive signal COM.

FIG. 5 is a diagram illustrating the waveform of a drive signal COM.

As illustrated in FIG. 5, the drive signal COM includes different voltage waveforms in a period T1 from a rising edge of the latch signal LAT to a rising edge of the change signal CH, in a period T2 from the lapse of the period T1 to a rising edge of the change signal CH next, and a period T3 from the lapse of the period T2 to a rising edge of the latch signal LAT, respectively. In this regard, a cycle including periods T1, T2, and T3 is a printing cycle Ta for forming a new dot on the medium P.

Specifically, as illustrated in FIG. 5, the drive circuit 50 generates a voltage waveform Adp in the period T1. The voltage waveform Adp is a voltage waveform that displaces the piezoelectric element 60 so as to discharge a predetermined quantity of ink, specifically, a moderate amount of ink from the nozzle N.

Also, the drive circuit 50 generates a voltage waveform Bdp in the period T2. The voltage waveform Bdp is a voltage waveform that displaces the piezoelectric element 60 so as to discharge a smaller amount than the predetermined quantity of ink from the nozzle N.

Also, the drive circuit 50 generates a voltage waveform Cdp in the period T3. The voltage waveform Cdp is a voltage waveform that displaces the piezoelectric element 60 so as not to discharge ink from the nozzle N. When the voltage waveform Cdp is supplied to the piezoelectric element 60, ink in the vicinity of a hole of the corresponding nozzle N vibrates slightly. Thereby, an increase in the viscosity of ink is prevented. Here, displacing the piezoelectric element 60 to the extent not to discharge ink from the nozzle N and causing ink in the vicinity of a hole of the corresponding nozzle N to vibrate slightly is simply referred to as a micro vibration.

In this regard, the voltage values at the start timing and the end timing of the voltage waveforms Adp, Bdp, and Cdp, which are generated by the drive circuit 50, are all voltage Vc in common. That is to say, the voltage waveforms Adp, Bdp, and Cdp start at the voltage Vc and end at the voltage Vc.

As described above, the drive circuit 50 outputs the drive signal COM having the continuous voltage waveform of the voltage waveforms Adp, Bdp, and Cdp in the printing cycle Ta.

Figure 6:
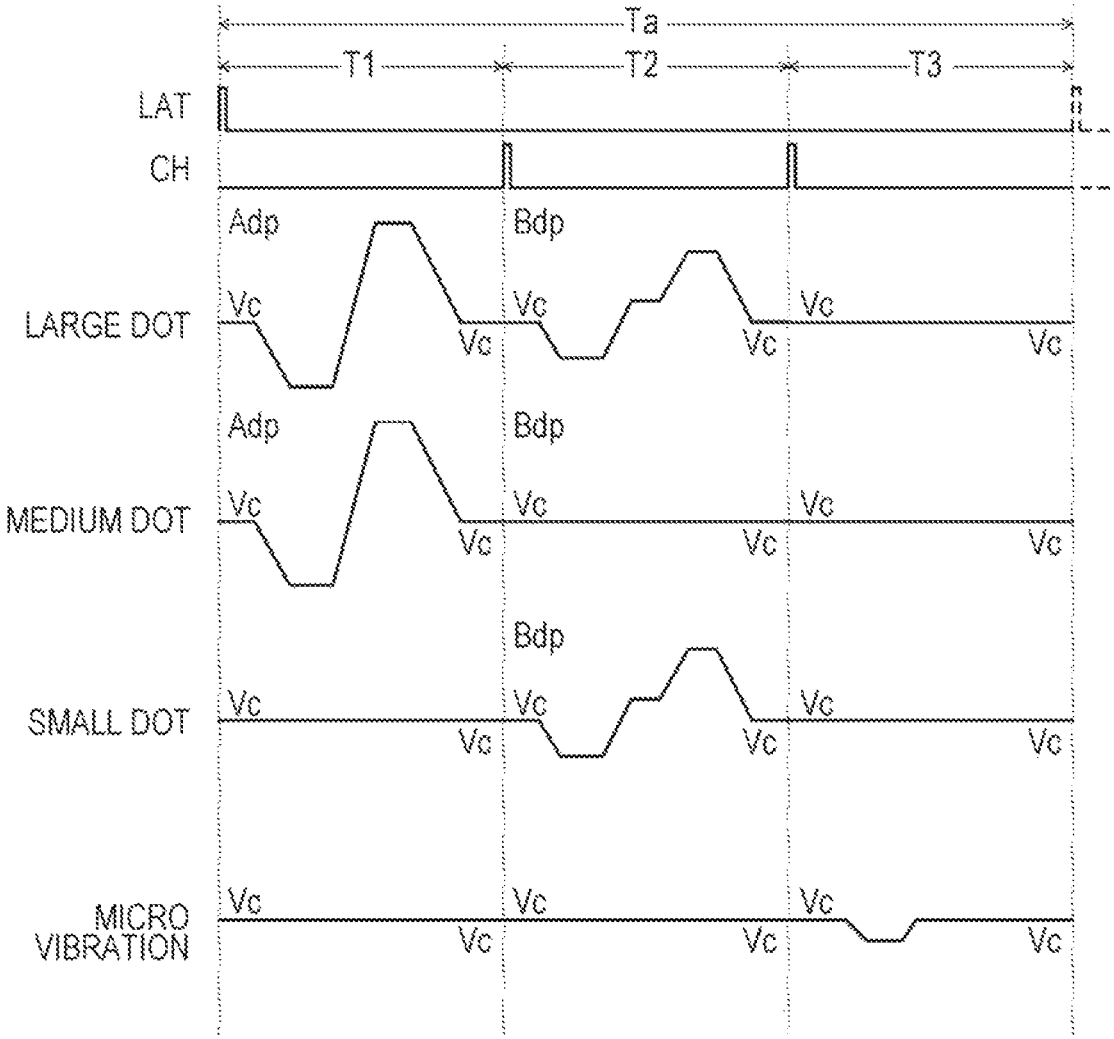
FIG. 6 is a diagram illustrating the waveforms of drive signals VOUT.

FIG. 6 is a diagram illustrating the waveforms of drive signals VOUT corresponding to a "large dot", a "medium dot", a "small dot" and "not recording" that are formed on the medium P, respectively.

As illustrated FIG. 6, the drive signal VOUT corresponding to a "large dot" is a continuous waveform of the voltage waveform Adp in the period T1, the voltage waveform Bdp in the period T2, and the voltage Vc in the period T3. When the drive signal VOUT in this case is supplied to one end of the piezoelectric element 60, a moderate amount of ink and a small amount of ink is discharged from the nozzle N corresponding to the piezoelectric element 60 in the printing cycle Ta. Accordingly, a large dot is formed on the medium P.

The drive signal VOUT corresponding to a "medium dot" is a continuous waveform of the voltage waveform Adp in the period T1 and the voltage Vc in the periods T2 and T3. When the drive signal VOUT in this case is supplied to one end of the piezoelectric element 60, a moderate amount of ink is discharged from the nozzle N corresponding to the piezoelectric element 60 in the printing cycle Ta. Accordingly, a medium dot is formed on the medium P.

The drive signal VOUT corresponding to a "small dot" is a continuous waveform of the voltage Vc in the periods T1 and T3 and the voltage waveform Bdp in the period T2. When the drive signal VOUT in this case is supplied to one end of the piezoelectric element 60, a small amount of ink is discharged from the nozzle N corresponding to the piezoelectric element 60 in the printing cycle Ta. Accordingly, a small dot is formed on the medium P.

The drive signal VOUT corresponding to a "micro vibration" is a continuous waveform of the voltage Vc in the periods T1 and T2 and the voltage waveform Cdp in the period T3. When the drive signal VOUT in this case is supplied to one end of the piezoelectric element 60, ink is not discharged from the nozzle N corresponding to the piezoelectric element 60, but micro vibration is performed in the printing cycle Ta.

1.5 Configuration of Discharge Head

Figure 7:
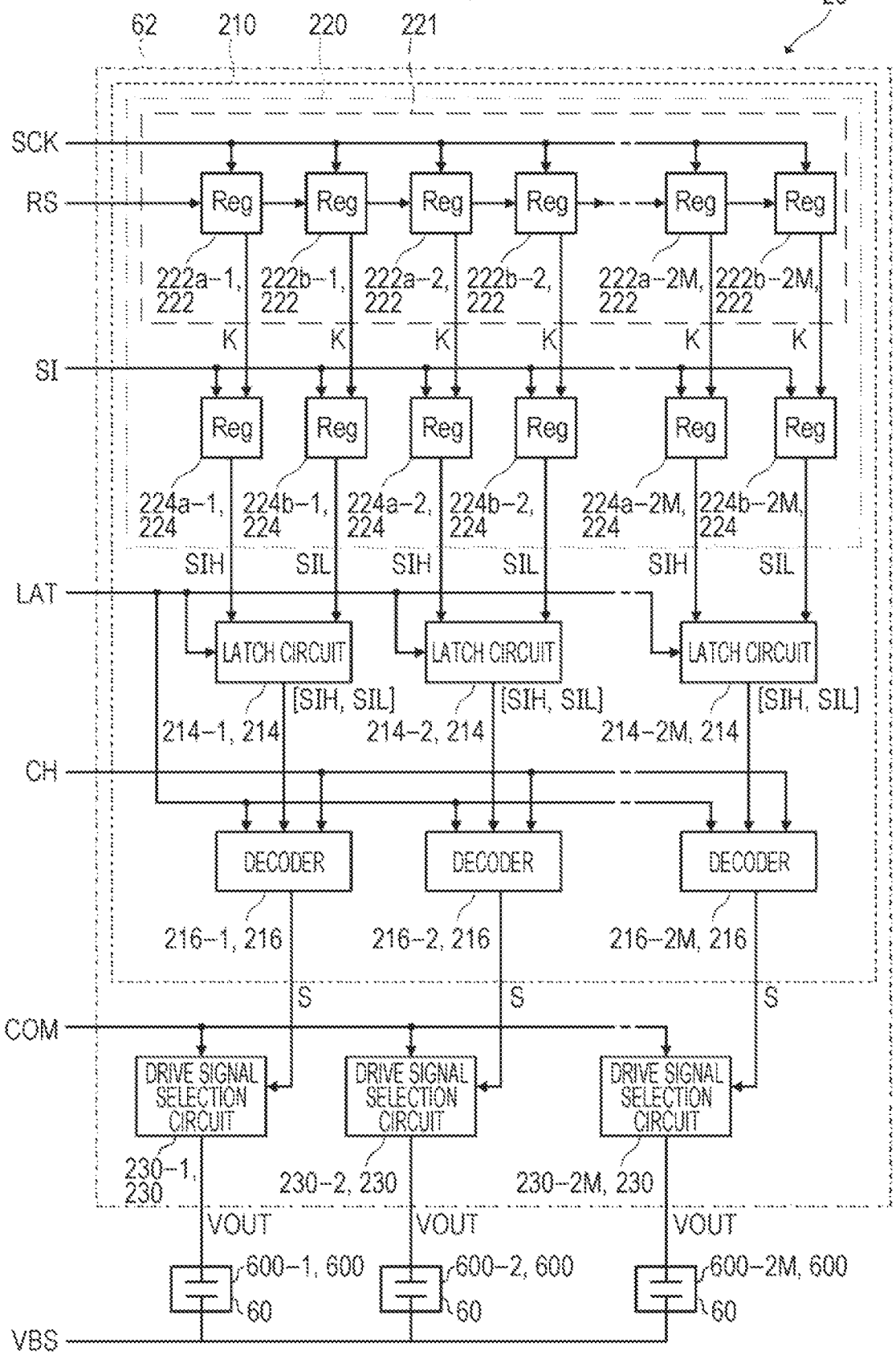
FIG. 7 is an electrical configuration illustrating the discharge head.

FIG. 7 is an electrical configuration illustrating the discharge head 20. As illustrated in FIG. 7, the discharge head 20 includes the drive IC 62 and a plurality of the discharge sections 600. Also, the drive IC 62 includes the selection control circuit 210 and a plurality of drive signal selection circuits 230.

The selection control circuit 210 includes a plurality of registers 222, registers 224, latch circuits 214, and decoders 216. The selection control circuit 210 is supplied with the clock signal SCK, the print data signal SI, the register selection signal RS, the latch signal LAT, and the change signal CH.

Here, the print data signal SI is a signal serially including 2-bit print data [SIH, SIL], which is associated with a corresponding one of the 2M discharge sections 600. Also, the register selection signal RS is a signal including 1-bit register selection data dRS. Both of the print data signal SI and the register selection signal RS are supplied to the selection control circuit 210 in synchronism with the clock signal SCK. In this regard, in the present embodiment, a description will be given on the assumption that the register selection data dRS is H-level data.

Each of the plurality of registers 222 is disposed in association with a corresponding one of the plurality of registers 224.

Also, the plurality of registers 222 are connected in cascade with each other. In other words, a plurality of registers 222 constitute a shift register circuit 221.

The shift register circuit 221 receives input of the register selection signal RS and transfers the register selection data dRS in accordance with the clock signal SCK.

Each of the plurality of registers 224 is commonly connected to a signal line supplied with the print data signal SI. When a corresponding one of the registers 222 holds the register selection data dRS, each of the registers 224 captures and holds the print data SIH or the print data SIL.

Specifically, each of the registers 224 receives input of a holding signal K, which is held in a corresponding one of the registers 222. If the holding signal K is a signal that indicates the register selection data dRS, each of the registers 224 captures and holds the print data SIH or the print data SIL.

In the present embodiment, a register 224 that captures and holds print data SIH is referred to as a register 224*a*, and a register 222 corresponding to the register 224*a* is referred to as a register 222*a*. Also, a register 224 that captures and holds print data SIL is referred to as a 224*b*, and a register 222 corresponding to the register 224*b* is referred to as a register 222*b*.

In this regard, detailed descriptions will be given later of the operation of the register 222 and the register 224.

Each of the plurality of latch circuits 214 is disposed in association with a corresponding one of the plurality of registers 224*a* and a corresponding one of the plurality of registers 224*b*. Each of the latch circuits 214 latches the print data SIH held by the corresponding register 224*a* and the print data SIL held by the corresponding register 224*b* as the print data [SIH, SIL] by a rising edge of the latch signal LAT. The print data [SIH, SIL] latched by the latch circuit 214 is input to the decoder 216.

Each of the plurality of decoders 216 is disposed in association with a corresponding one of the plurality of latch circuits 214. Each of the decoders 216 decodes print data [SIH, SIL] input from a corresponding one of the latch circuits 214 and outputs a drive signal selection signal S.

Figures 8, 9:
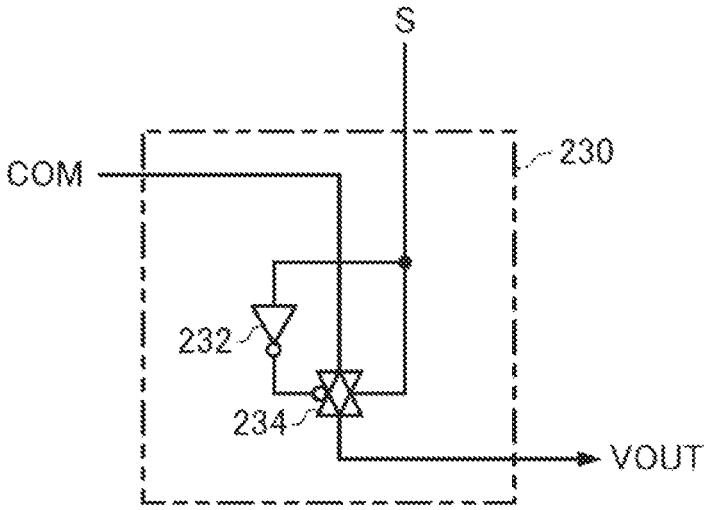
FIG. 8 is a diagram illustrating decoding contents.
FIG. 9 is an electrical configuration diagram of a drive signal selection circuit.

FIG. 8 is a diagram illustrating decoding contents by the decoder 216.

The decoder 216 receives input of the print data [SIH, SIL] output from the latch circuit 214, the latch signal LAT, and the change signal CH. The decoder 216 outputs the drive signal selection signal S having a logic level based on the print data [SIH, SIL] in the periods T1, T2, and T3 that are specified by the latch signal LAT and the change signal CH.

Specifically, if the print data [SIH, SIL] is [1, 1], which specifies a "large dot", the decoder 216 outputs the drive signal selection signal S that becomes an H level, an H level, and an L level in the periods T1, T2, and T3, respectively.

Also, if the print data [SIH, SIL] is [1, 0], which specifies a "medium dot", the decoder 216 outputs the drive signal selection signal S that becomes the H level, the L level, and the L level in the periods T1 and T2, and T3, respectively.

Also, if the print data [SIH, SIL] is [0, 1], which specifies a "small dot", the decoder 216 outputs the drive signal selection signal S that becomes the L level, the H level, and the L level in the periods T1, T2, and T3, respectively.

Also, if the print data [SIH, SIL] is [0, 0], which specifies a "micro vibration", the decoder 216 outputs the drive signal selection signal S that becomes the L level, the L level and the H level in the periods T1, T2, and T3, respectively.

Sets of the registers 222*a* and 222*b*, the registers 224*a* and 224*b*, the latch circuit 214, and the decoder 216 are disposed correspondingly to the respective 2M discharge sections 600.

In the following description, a register 224 that captures print data SIH-i corresponding to a discharge section 600-*i* including the i-th (i=1 to 2M) nozzle N is referred to as a register 224*a*-*i*, and a register 224 that captures print data SIL-i is referred to as a register 224*b*-*i*.

Also, a register 222*a* corresponding to a register 224*a*-*i* is referred to as a register 222*a*-*i*, and a register 222*b* corresponding to a register 224*b*-*i* is referred to as a register 222*b*-*i*.

A latch circuit 214 corresponding to registers 224*a*-*i* and 224*b*-*i* is referred to as a latch circuit 214-*i*, and a decoder 216 corresponding to a latch circuit 214-*i* is referred to as a decoder 216-*i*.

That is to say, if it is assumed that the first nozzle N corresponds to the first nozzle described above, print data SIH-1 corresponding to the discharge section 600-1 corresponds to the "first data" described above.

The print data SIH-1 is captured and held by the corresponding register 224*a*-1 when the register selection data dRS is held by the register 222*a*-1. That is to say, the register 224*a*-1 corresponds to the "first register" described above, and the register 222*a*-1 corresponds to the "third register" described above.

Also, if it is assumed that the second nozzle N corresponds to the second nozzle described above, print data SIH-2 corresponding to the discharge section 600-2 corresponds to the "second data" described above.

The print data SIH-2 is captured and held by the corresponding the register 224*a*-2 when the register selection data dRS is held by the register 222*a*-2. That is to say, the register

224*a*-2 corresponds to the "second register" described above, and the register 222*a*-2 corresponds to the "fourth register" described above.

Each of the plurality of drive signal selection circuit 230 is disposed in association with a corresponding one of the plurality of decoders 216. Each of the drive signal selection circuits 230 changes whether to select or not to select the voltage waveforms Adp, Bdp, and Cdp of the drive signal COM in the periods T1, T2, and T3, respectively, based on the drive signal selection signal S input from the corresponding decoder 216 so as to generate and output the drive signal VOUT.

Also, the drive signal selection circuits 230 are disposed in accordance with a corresponding one of the discharge sections 600. That is to say, the number of the drive signal selection circuits 230 of one discharge head 20 is the same as the total number 2M of the discharge sections 600 included in the discharge head 20.

FIG. 9 is an electrical configuration diagram of a drive signal selection circuit 230 corresponding to one discharge section 600.

As illustrated in FIG. 9, the drive signal selection circuit 230 includes an inverter circuit 232 and a transfer gate 234.

The drive signal selection signal S is supplied to a positive control end of transfer gate 234, which is not given a circular mark. Also, the drive signal selection signal S is subjected to logic inversion by the inverter circuit 232, and is also supplied to a negative control end of the transfer gate 234, which is given a circular mark.

If the drive signal selection signal S is the H level, the transfer gate 234 causes the input end and the output end to be electrically connected, whereas if the drive signal selection signal S is the L level, the transfer gate 234 causes the input end and the output end to be electrically disconnected.

The input end of the transfer gate 234 is supplied with the drive signal COM. The voltage signal that occurs at the output end of the transfer gate 234 is supplied to the discharge section 600 as the drive signal VOUT. That is to say, if the drive signal selection signal S is the H level, the drive signal selection circuit 230 outputs the voltage waveform included in the drive signal COM as the drive signal VOUT, whereas if the drive signal selection signal S is the L level, the drive signal selection circuit 230 does not output the voltage waveform included in the drive signal COM as the drive signal VOUT.

In this regard, in the following description, a drive signal selection circuit 230 corresponding to the i-th (i=1 to 2M) discharge section 600-I is referred to as a drive signal selection circuit 230-*i*.

1.6 Configuration and Operation of Register 222 and Register 224

Here, a description will be given of the configurations and the operation of the register 222 and the register 224 with reference to FIG. 10 and FIG. 11.

Figure 10:
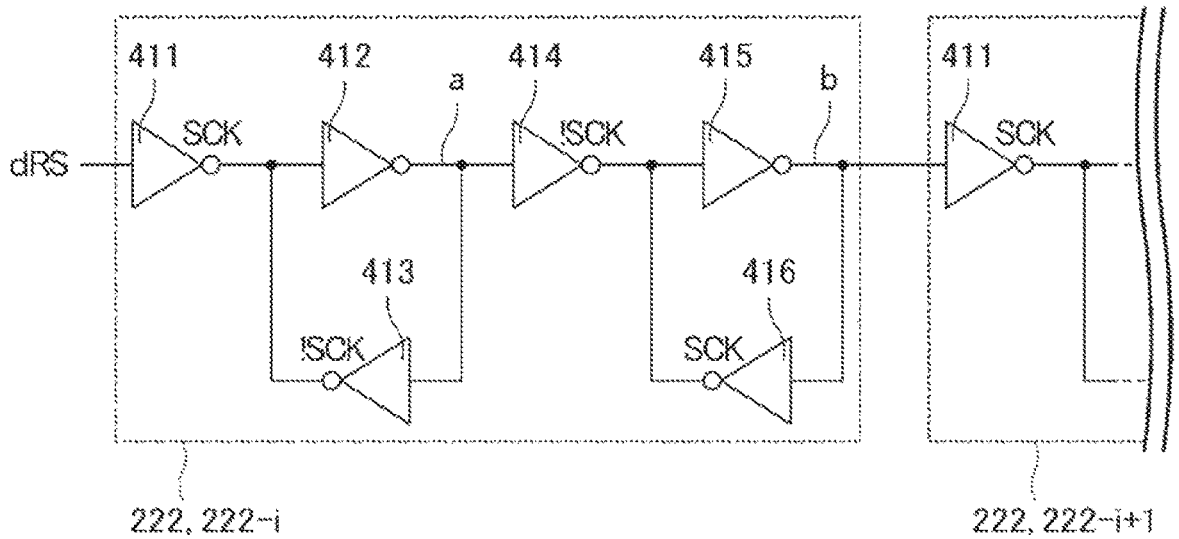
FIG. 10 is a diagram illustrating the configuration of a register.

FIG. 10 is a diagram illustrating the configuration of the register 222. As illustrated in FIG. 10, the register 222 includes inverter circuits 411, 412, 413, 414, 415, and 416. Among these, the inverter circuits 411 and 416 are clocked inverter circuits that invert the input bit data and output the bit data if the input clock signal SCK is the H level. Also, the inverter circuits 413 and 414 are clocked inverter circuits that invert the input bit data and output the bit data if the input clock signal SCK is the L level.

In this regard, in FIG. 10, an inverter circuit that inverts and outputs bit data when the clock signal SCK is the H level is denoted by a sign of a circuit diagram with "SCK", and an inverter circuit that inverts and outputs bit data when the clock signal SCK is the L level is denoted by a sign of a circuit diagram with "!SCK".

The input end of the inverter circuit 411 is supplied with the register selection data dRS. Also, the output end of the inverter circuit 411 is connected to the input end of the inverter circuit 412 and the output end of the inverter circuit 413.

The output end of the inverter circuit 412 is connected to the input end of the inverter circuit 413 and the input end of the inverter circuit 414.

The output end of the inverter circuit 414 is connected to the input end of the inverter circuit 415 and the output end of the inverter circuit 416.

The output end of the inverter circuit 415 is connected to the input end of the inverter circuit 416 and the input end of the inverter circuit 411 included in the register 222 in the later stage.

In such a register 222, when the clock signal SCK is the H level, the register selection data dRS is captured and is held at a node a to which the output end of the inverter circuit 413 and the input end of the inverter circuit 412 are connected.

The data held at the node a is output to the register 224 as the holding signal K. In this regard, as described above, the register selection data dRS in the present embodiment is the H level data. Accordingly, when the node a holds the register selection data dRS, an H level signal is output to the register 224 as the holding signal K.

After that, when the clock signal SCK becomes the L level, the register selection data dRS held at the node a is also held at a node b to which the output end of the inverter circuit 415 and the input end of the inverter circuit 416 are connected.

After that, when the clock signal SCK becomes the H level, the register selection data dRS held at the node b is transferred to the register 222 disposed in the later stage, and the data input from the input end of the inverter circuit 411 is held at the node a.

In this manner, the cascade connection of the registers 222 constitutes the shift register circuit 221 that transfers the register selection data dRS.

Figure 11:
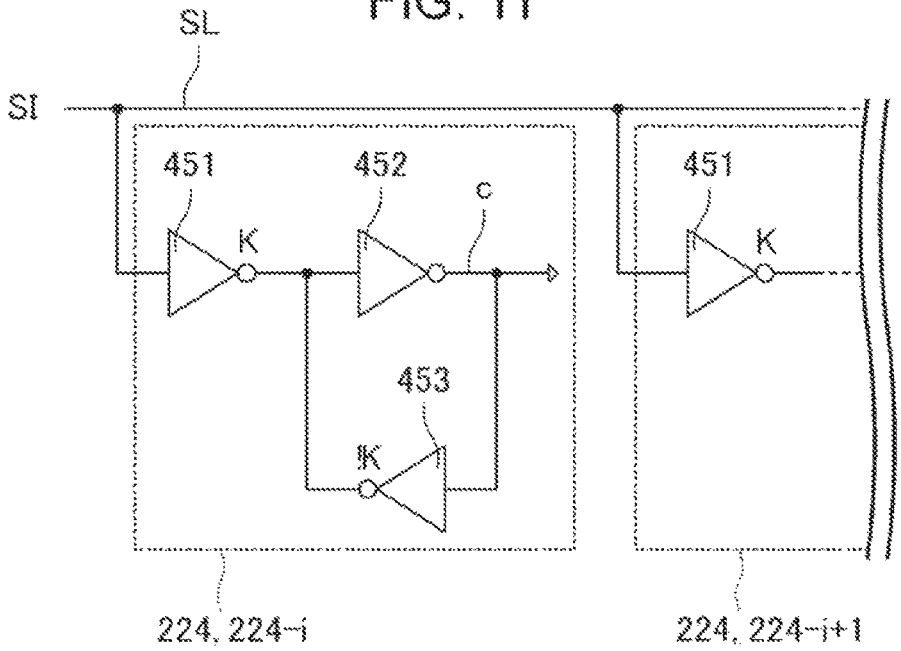
FIG. 11 is a diagram illustrating the configuration of a register.

FIG. 11 is a diagram illustrating the configuration of the register 224. As illustrated in FIG. 11, the register 224 includes inverter circuits 451, 452, and 453. Among these, the inverter circuit 451 is a clocked inverter circuit that inverts and outputs input bit data when the input holding signal K is the H level. Also, the inverter circuit 453 is a clocked inverter circuit that inverts and outputs input bit data when the input holding signal K is the L level.

In this regard, in FIG. 11, an inverter circuit that inverts and outputs bit data when the holding signal K is the H level is denoted by a sign of a circuit diagram with "K", and an inverter circuit that inverts and outputs bit data when the holding signal K is the L level is denoted by a sign of a circuit diagram with "!K".

The input end of the inverter circuit 451 is connected to a signal line SL on which the print data signal SI is transferred. Also, the output end of the inverter circuit 451 is connected to the input end of the inverter circuit 452 and the output end of the inverter circuit 453.

The output end of the inverter circuit 452 is connected to the input end of the inverter circuit 453.

In such a register 224, when the holding signal K is the H level, the print data SIH or the print data SIL included in the print data signal SI transferred on the signal line SL is captured and is held at a node c to which the output end of the inverter circuit 452 and the input end of the inverter circuit 453 are connected.

On the other hand, when the holding signal K is the L level, the print data SIH and the print data SIL are not captured. Accordingly, the data held at the node c is continued to be held until the holding signal K becomes the H level.

The data held at the node c is then latched in the latch circuit 214 by a rising edge of the latch signal LAT.

As described above, the register 222 and the register 224 hold in the register 224 in sequence the print data [SIH, SIL] that is serially transferred based on the register selection data dRS, and the latch circuit 214 latches the print data [SIH, SIL] so as to convert the print data [SIH, SIL] into parallel print data [SIH, SIL]. That is to say, the plurality of registers 222 and the plurality of registers 224 function as a serial-to-parallel conversion circuit 220.

1.7 Operation of Serial-to-Parallel Conversion Circuit

Figure 12:
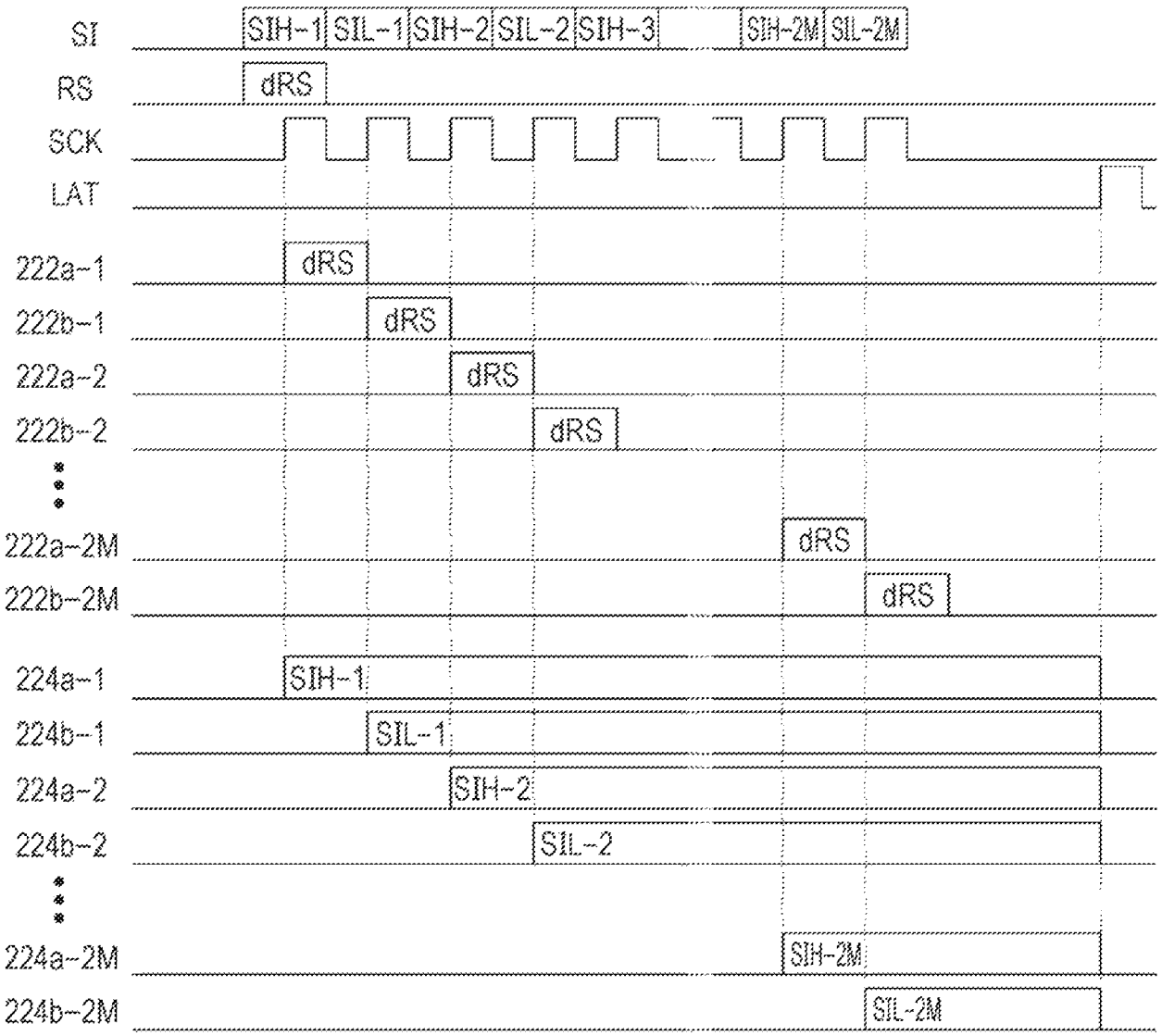
FIG. 12 is a timing chart for describing operation of a serial-to-parallel conversion circuit.

A description will be given of the operation of the serial-to-parallel conversion circuit 220 with reference to FIG. 12. FIG. 12 is a timing chart for describing the operation of the serial-to-parallel conversion circuit 220.

The discharge head 20 is supplied with the print data signal SI and the register selection signal RS in synchronism with the clock signal SCK.

In this regard, in the following description, a description will be given on the assumption that 2-bit print data [SIH, SIL] serially included in a print data signal SI include print data SIH-1, SIL-1, SIH-2, SIL-2 . . . SIH-2M, and SIL-2M in this order. Also, the register selection data dRS included in the register selection signal RS is a signal in synchronism with the print data SIH-1.

The register 222*a*-1 captures and holds register selection data dRS by a rising edge of the clock signal SCK. At this time, the holding signal K corresponding to the register 224*a*-1 becomes the H level, and the register 224*a*-1 captures and holds the print data SIH-1.

At the next rising edge of the clock signal SCK, the register selection data dRS held by the register 222*a*-1 is transferred to the register 222*b*-1 and is held by the register 222*b*-1. At this time, the data held by the register 222*a*-1 becomes the L level, the holding signal K corresponding to the register 224*a*-1 becomes the L level, and the holding signal K corresponding to the register 224*b*-1 becomes the H level. Accordingly, the register 224*b*-1 captures and holds the print data SIL-1.

At the next rising edge of the clock signal SCK, the register selection data dRS held by the register 222*b*-1 is transferred to the register 222*a*-2 and is held by the register 222*a*-2. At this time, the data held by the register 222*b*-1 becomes the L level, the holding signal K corresponding to the register 224*b*-1 becomes the L level, and the holding signal K corresponding to the register 224*a*-2 becomes the H level. Accordingly, the register 224*a*-2 captures and holds the print data SIH-2.

At the next rising edge of the clock signal SCK, the register selection data dRS held by the register 222*a*-2 is transferred to the register 222*b*-2 and is held by the register 222*b*-2. At this time, the data held by the register 222*a*-2 becomes the L level, the holding signal K corresponding to the register 224*a*-2 becomes the L level, and the holding signal K corresponding to the register 224*b*-2 becomes the H level. Accordingly, the register 224*b*-2 captures and holds the print data SIL-2.

As described above, the register selection data dRS is transferred to the register 222 of the later stage in sequence so that the register 224 holds the print data SIH or the print data SIL in sequence.

The register 224*b*-2M then holds the print data SIL-2M, and the latch signal LAT rises after the lapse of a predetermined time period. The latch circuit 214 then outputs the print data SIH held by the register 224*a* and the print data SIL held by the register 224*b* to the decoder 216 as print data [SIH, SIL].

As described above, the serial-to-parallel conversion circuit 220 according to the present embodiment selects in sequence the print data SIH or the print data SIL that are serially supplied based on the register selection data dRS, and captures and holds the data in a corresponding register 224.

That is to say, the register selection data dRS functions as a pointer signal for holding the print data SIH and the print data SIL in a corresponding register 224.

The print data SIH and the print data SIL are serially included in the print data signal SI. Accordingly, the register selection data dRS that functions as a pointer signal for holding the print data SIH and the print data SIL in a corresponding one of the registers 224 does not select a plurality of registers 224 at the same time. In other words, the register selection data dRS exclusively selects one of the plurality of registers 224 in the shift register circuit 221. The shift register circuit 221 that transfers the register selection data dRS in sequence corresponds to the "register selection circuit" described above.

1.8 Advantages

In the liquid discharge apparatus 1 described above, a plurality of registers 224 that are corresponding to the respective discharge sections 600 are commonly connected to the signal line SL on which the print data signal SI is transferred. The registers 224 then capture and hold the print data SIH or the print data SIL in sequence based on the register selection data dRS included in the register selection signal RS in synchronism with the print data signal SI. Thereby, it is possible to convert the print data signal SI serially including the print data [SIH, SIL] into parallel print data [SIH, SIL] for each of the corresponding discharge section 600.

For a configuration that converts a serial signal into parallel signals, a configuration using a shift register is known. A shift register holds an input signal and transfers the signal to a register in the later stage so as to convert the serial signal into a parallel signal.

In such a shift register, power consumption occurs because of the charging and discharging of the gate of the transistors included in the inverter circuit of the registers that constitute the shift register and a through current that arises at the time of rewriting the registers.

When a serial signal including a large number of bits is converted into parallel signals using the shift register, the number of registers that constitute the shift register increases. Accordingly, the data included in the serial signal is transferred to a register to hold the data via a large number of registers. That is to say, with an increase in the number of bits of the serial signal to be transferred, the number of registers that constitute the shift register increases. Accordingly, the number of rewriting times of each register increases, and the power consumption of the shift register increases.

On the other hand, with the serial-to-parallel conversion circuit 220 according to the present embodiment, a plurality of registers 224 are commonly connected to the signal line SL on which the print data signal SI, which is a serial signal, is transferred, and the corresponding print data SIH or print data SIL are held in the register 224 based on the register selection data dRS. Accordingly, even if the number of bits of the serial signal to be transferred is increased, it becomes possible to reduce the number of times of rewriting the registers. It is therefore possible to reduce the power consumption of the shift register. Further, reduction of the power consumption of the shift register results in reduction of heat generation of the drive IC 62 including the serial-to-parallel conversion circuit 220.

Figure 13:
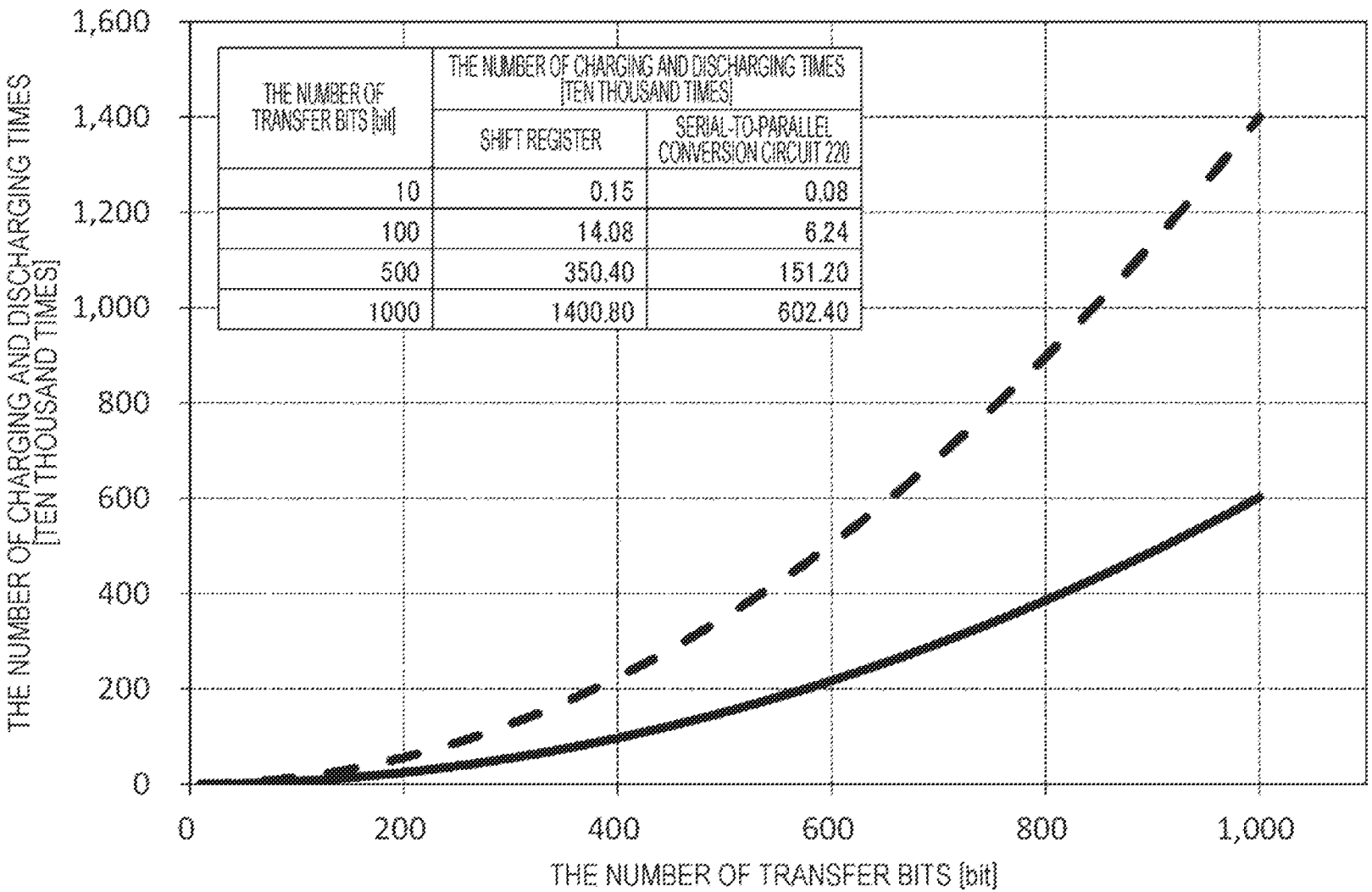
FIG. 13 is a simulation result illustrating the number of charging and discharging times of a gate of a transistor.

FIG. 13 is a simulation result illustrating the number of charging and discharging times of a gate of a transistor included in a register when the same serial signal is converted into parallel signals in the serial-to-parallel conversion circuit 220 according to the present embodiment and a shift register. In FIG. 13, the horizontal axis represents the number of bits of transfer data, and the vertical axis represents the number of charging and discharging times of the gate. Also, in FIG. 13, a graph that indicates the number of charging and discharging times that occur in the serial-to-parallel conversion circuit 220 according to the present embodiment is denoted by a solid line, and a graph that indicates the number of charging and discharging times that occur in the shift register is denoted by a broken line. Also, in FIG. 13, the numbers of charging and discharging times of a gate are illustrated by numeric values in the case where the number of bits of the data to be transferred is 10 bits, 100 bits, 500 bits, and 1000 bits, respectively.

As illustrated in FIG. 13, when the number of pieces of data transferred by a serial signal is 1000 bits, in the case of using the serial-to-parallel conversion circuit 220 according to the present embodiment, it becomes possible to reduce the number of charging and discharging times of a gate by approximately 60% with respect to the case of using a shift register.

Figure 14:
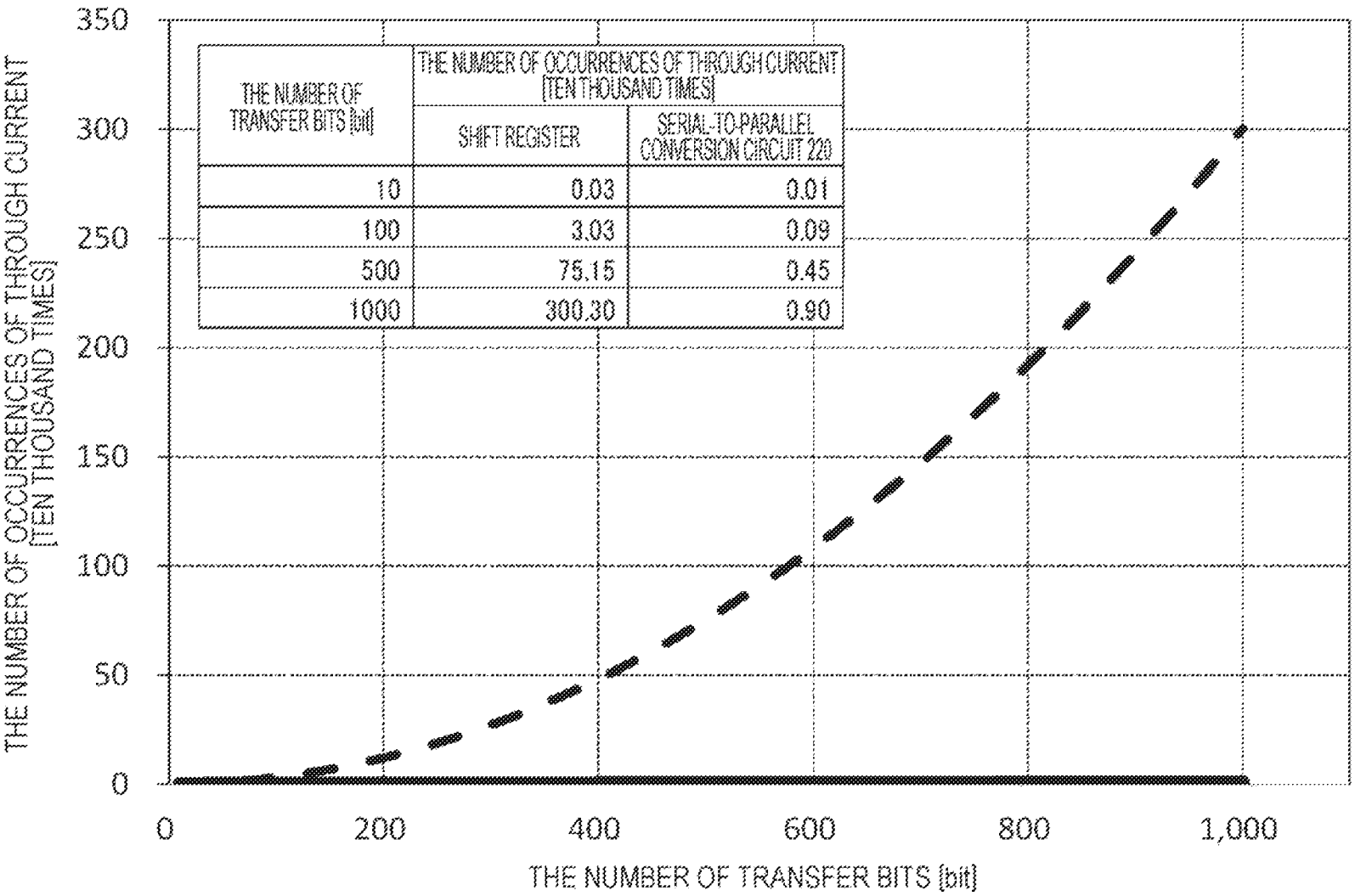
FIG. 14 is a simulation result illustrating the number of occurrences of a through current.

Also, FIG. 14 is a simulation result illustrating the number of occurrences of a through current when the same serial signal is converted into parallel signals in the case of using the serial-to-parallel conversion circuit 220 according to the present embodiment and in the case of using a shift register. In FIG. 14, the horizontal axis represents the number of bits of transfer data, and the vertical axis represents the number of occurrences of a through current. Also, in FIG. 14, a graph that indicates the number of occurrences of a through current in the serial-to-parallel conversion circuit 220 according to the present embodiment is denoted by a solid line, and a graph that indicates the number of occurrences of a through current in the shift register is denoted by a broken line. Also, in FIG. 14, the numbers of occurrences of a through current are illustrated by numeric values in the case where the number of bits of the data to be transferred is 10 bits, 100 bits, 500 bits, and 1000 bits, respectively.

As illustrated in FIG. 14, when the number of pieces of data transferred by a serial signal is 1000 bits, in the case of using the serial-to-parallel conversion circuit 220 according to the present embodiment, it becomes possible to reduce the number of occurrences of a through current by approximately 99% with respect to the case of using a shift register.

From the above simulation result, it is understood that the serial-to-parallel conversion circuit 220 according to the present embodiment significantly reduces the power consumption. Accordingly, it is possible to significantly reduce heat generation by the serial-to-parallel conversion circuit 220.

Further, in the liquid discharge apparatus 1, the print data [SIH, SIL] included in the print data signal SI, which is a serial signal, increases with an increase in the number of nozzles. In other words, the number of bits of the serial signal increases with an increase in the number of nozzles.

Even if the number of bits of the serial signal to be transferred is increased, it is possible for the liquid discharge apparatus 1 according to the present embodiment to reduce the increase in the number of rewriting times of a register. Accordingly, for example, in the case where one discharge head 20 includes as many as 600 or more nozzles N, it is possible to reduce power consumption of the serial-to-parallel conversion circuit 220, and thus to reduce heat generation of the serial-to-parallel conversion circuit 220.

Also, the power consumption of the serial-to-parallel conversion circuit 220 is reduced so that the heat generation is reduced. Thus, even if the drive IC 62 including the serial-to-parallel conversion circuit 220 is disposed in the vicinity of the ink channel as illustrated in FIG. 4, a change in the viscosity of ink supplied to the channel, and the like due to heat is reduced. Accordingly, it becomes possible to improve the discharge precision without preventing miniaturization of the discharge head 20.

1.9 Variation

In the liquid discharge apparatus 1 according to the first embodiment described above, a description has been given that the register selection signal RS and the print data signal SI are supplied to the discharge head 20 as separate signals. However, for example, the register selection data dRS may be added in front of the print data [SIH, SIL] included in the print data signal SI, and the register selection data dRS may be separated inside the discharge head 20 or the drive IC 62. Thereby, it becomes possible to reduce wiring lines that connects the control unit 10 and the discharge head 20.

Also, among the registers 222 that constitute the shift register circuit 221, the output of the last-stage register 222*b*-2M may be input to the first-stage register 222*a*-1. In other words, the registers 222 that constitute the shift register circuit 221 may be configured in a loop state.

2. Second Embodiment

Next, a description will be given of a liquid discharge apparatus 1 according to a second embodiment with reference to FIG. 15 to FIG. 19.

The liquid discharge apparatus 1 according to the second embodiment differs from that of the first embodiment in the point that the serial-to-parallel conversion circuit 220 includes a reset circuit 228. For the other configuration, the liquid discharge apparatus 1 of the first embodiment and the liquid discharge apparatus 1 of the second embodiment have the same configuration. Also, the second embodiment differs from the first embodiment in the point that the register selection data dRS is generated based on the reset signal RST. Hereinafter, a duplicated description with that of the first embodiment will be omitted or simplified, and a description will be mainly given of the contents that differ from those of the first embodiment.

Figure 15:
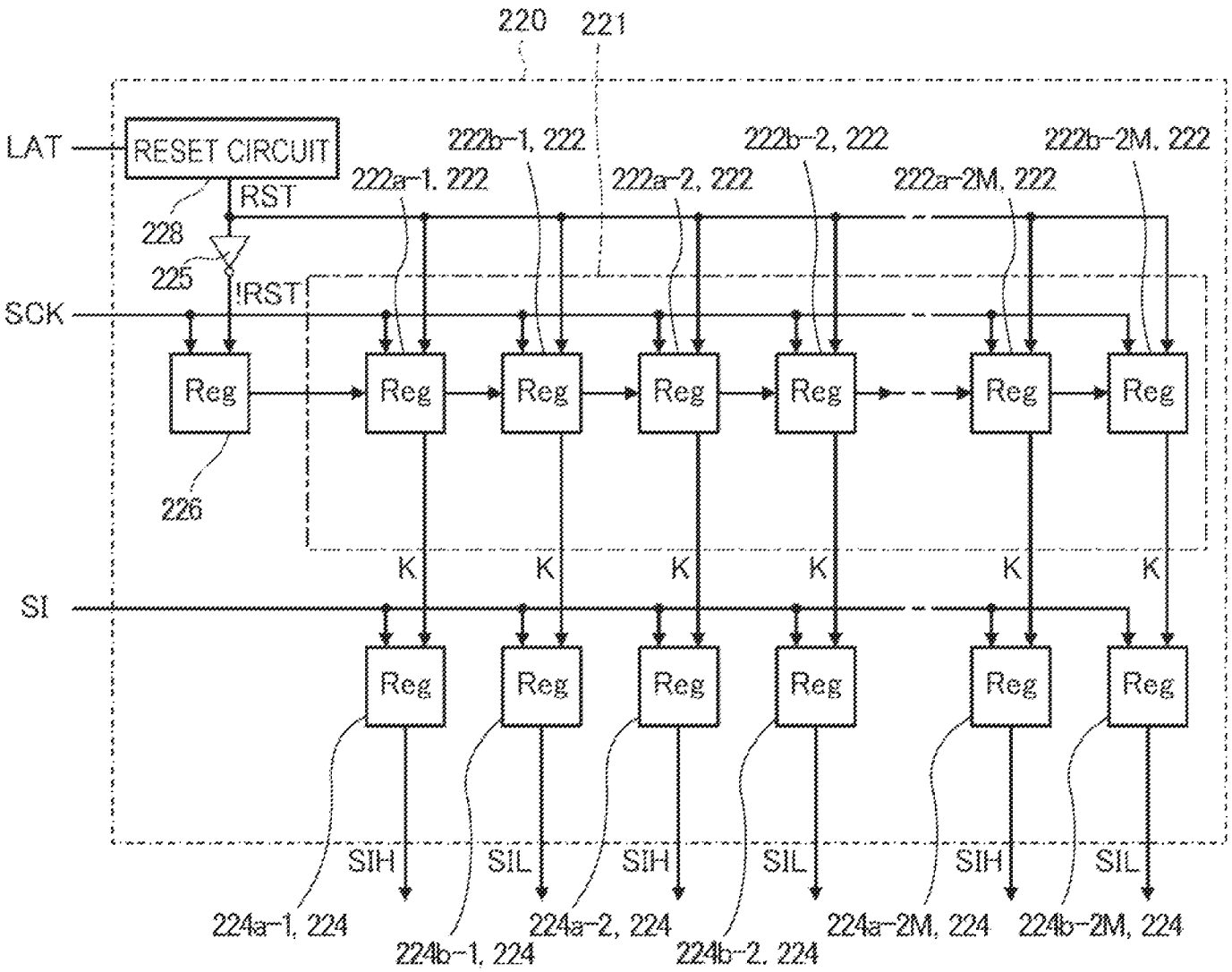
FIG. 15 is an electrical configuration diagram illustrating the configuration of a serial-to-parallel conversion circuit according to a second embodiment.

FIG. 15 is an electrical configuration diagram illustrating the configuration of a serial-to-parallel conversion circuit 220 according to the second embodiment.

The serial-to-parallel conversion circuit 220 according to the second embodiment includes a plurality of registers 222, a plurality of registers 224, an inverter circuit 225, a register 226, and a reset circuit 228.

When power to the liquid discharge apparatus 1 is turned on, and the clock signal SCK is the L level, the reset circuit 228 outputs an H-level reset signal RST. Also, when supplying the print data signal SI to the discharge head 20 is ended, and after the latch signal LAT arises, if a predetermined time elapses, and the clock signal SCK is the L level, the reset circuit 228 outputs the H-level reset signal RST.

When the reset signal RST is input to each of the plurality of registers 222, each of the registers 222 sets the holding data to the L level. That is to say, when supplying the print data signal SI is ended, and after the latch signal LAT arises, the data held by the plurality of registers 222 is reset by the reset signal RST.

When the reset signal RST is input to the inverter circuit, the inverter circuit inverts the logic level of the reset signal RST and outputs the L-level reset signal !RST.

When the reset signal !RST is input to the register 226, the register 226 sets the holding data to the H level.

The register 226 is disposed at the input side of the shift register circuit 221. The H-level data held by the register 226 is input to the shift register circuit 221 in accordance with the clock signal SCK.

The shift register circuit 221 transfers the H-level signal in accordance with the clock signal SCK. That is to say, the H-level data held by the register 226 functions as the register selection data dRS. In other words, the print data signal SI is supplied and after the latch signal LAT arises, the register selection data dRS is set in the input of the shift register circuit 221.

Figure 16:
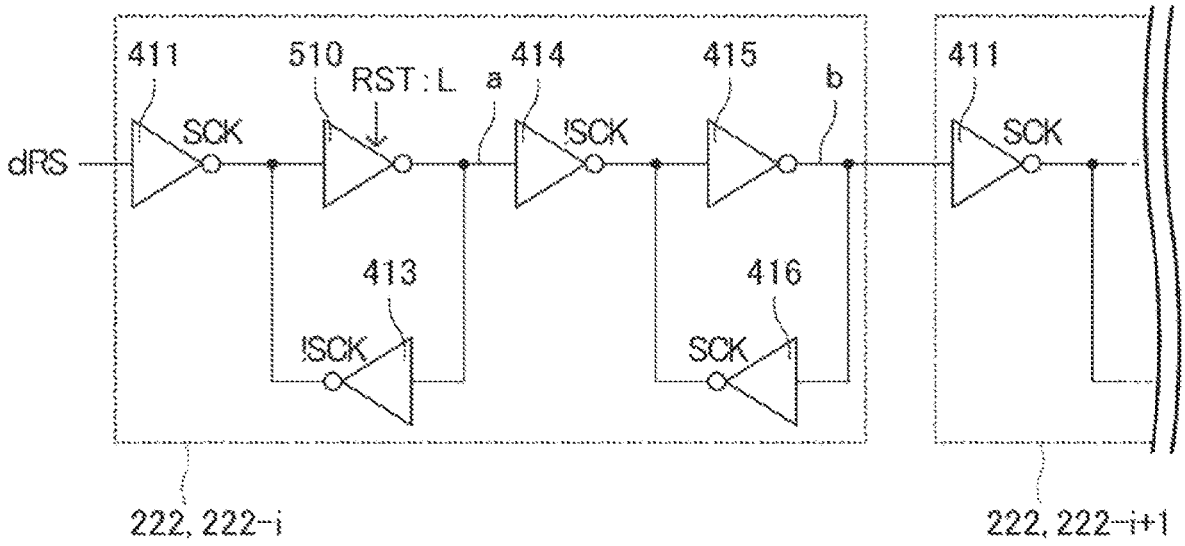
FIG. 16 is an electrical configuration diagram illustrating the configuration of the register according to the second embodiment.
Figure 17:
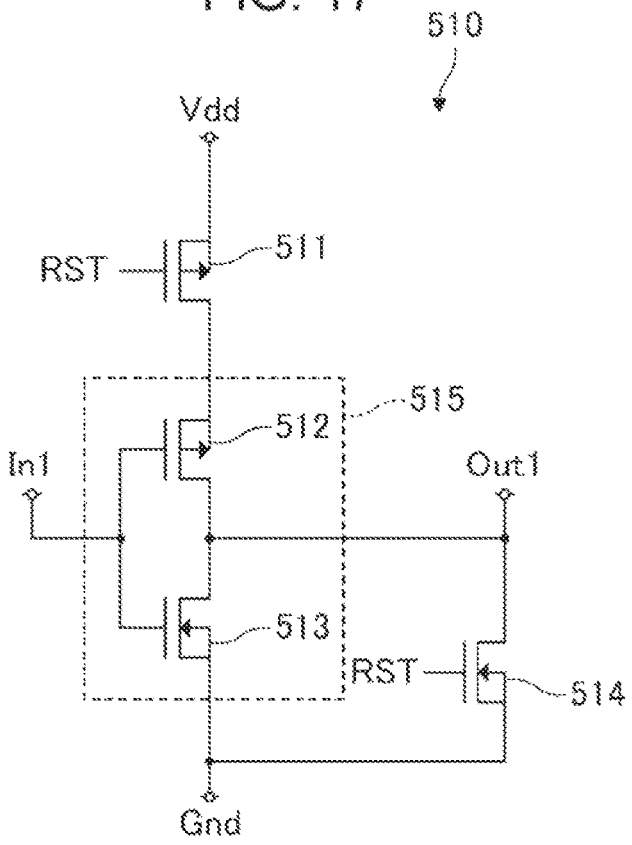
FIG. 17 is an electrical configuration diagram illustrating the configuration of an inverter circuit.

Here, a specific description will be given of the configuration of a plurality of registers 222 and the reset operation with reference to FIG. 16 and FIG. 17. FIG. 16 is an electrical configuration diagram illustrating the configuration of the register 222.

As illustrated in FIG. 16, the register 222 according to the second embodiment differs from the register 222 according to the first embodiment in the point that the inverter circuit 412 in the first embodiment is replaced with the inverter circuit 510.

When the reset signal RST is input to the inverter circuit 510, the inverter circuit 510 outputs the L-level signal. In this regard, in FIG. 16, an inverter circuit that outputs the L-level signal by receiving the reset signal RST is denoted by a circuit diagram sign with "RST: L".

Here, a description will be given of the inverter circuit 510 with reference to FIG. 17. FIG. 17 is an electrical configuration diagram illustrating the configuration of an inverter circuit 510.

The inverter circuit 510 includes transistors 511 and 512 that are P-type transistors and transistors 513 and 514 that are N-type transistors.

The source of the transistor 512 is connected to the drain of the transistor 511. Also, the gate of the transistor 512 is commonly connected to an input terminal In1, which is the gate of the transistor 513 and the input end of the inverter circuit 510. Also, the drain of the transistor 512 is commonly connected to an output terminal Out1, which is the drain of the transistor 513 and the output end of the inverter circuit 510. Also, the source of the transistor 513 is connected to a terminal Gnd, which is the ground potential.

As described above, the transistors 512 and 513 constitute an inverter circuit 515 that inverts the logic level of data input to the input terminal In1 and outputs the inverted logic level data to the output terminal Out1.

The source of the transistor 511 is connected to a terminal Vdd supplied with the H-level voltage signal. Also, the gate of the transistor 511 receives input of the reset signal RST.

The drain of the transistor 514 is connected to the output terminal Out1. The gate of the transistor 514 receives input of the reset signal RST. The source of the transistor 513 is connected to the terminal Gnd, which is the ground potential.

When the reset signal RST is input to the inverter circuit 510, the transistor 514 becomes ON. At this time, the ground potential signal, which is the L-level signal, is output to the output terminal Out1 via the transistor 514.

Also, when the reset signal RST is input to the inverter circuit 510, the transistor 511 becomes OFF. Thereby, the H-level voltage is not supplied to the source of the transistor 512. That is to say, the inverter circuit 510 does not output the H-level signal regardless of the signal input thereto.

Thus, when the reset signal RST is input to the inverter circuit 510, the inverter circuit 510 outputs the L-level signal to the node a illustrated in FIG. 16.

Referring back to FIG. 16, when the clock signal SCK is the L level, the reset circuit 228 outputs the reset signal RST. That is to say, when the reset signal RST is input to the register 222, the clock signal SCK is the L level. Accordingly, the inverter circuits 411 and 416 do not operate. Accordingly, the L-level data output by the inverter circuit 510 is held at the node a.

Figure 18:
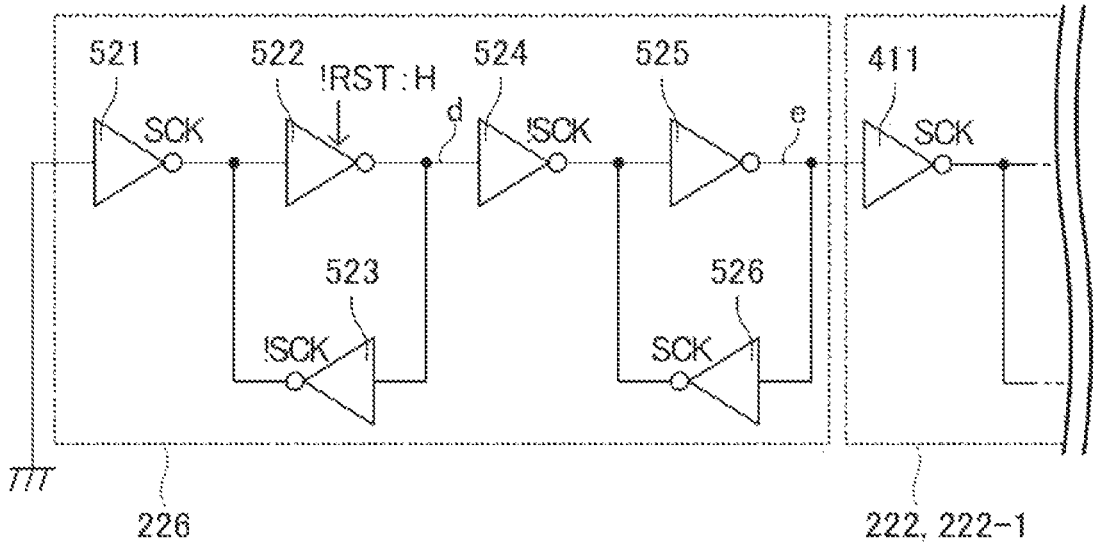
FIG. 18 is an electrical configuration diagram illustrating the configuration of a register.

FIG. 18 is an electrical configuration diagram illustrating the configuration of a register 226.

The register 226 includes inverter circuits 521, 522, 523, 524, 525, and 526. The inverter circuits 521 and 526 are clocked inverter circuits that invert the input bit data and output the bit data when the input clock signal SCK is the H level. Also, the inverter circuits 523 and 524 are clocked inverter circuits that invert the input bit data and output the bit data when the input clock signal SCK is the L level. Also, the inverter circuit 522 outputs the H-level signal when the L-level reset signal !RST is input.

In this regard, in FIG. 18, an inverter circuit that inverts and outputs bit data when the clock signal SCK is the H level is denoted by a sign of a circuit diagram with "SCK", and an inverter circuit that inverts and outputs bit data when the clock signal SCK is the L level is denoted by a sign of a circuit diagram with "!SCK". Also, an inverter circuit that outputs the H-level signal by receiving the L-level reset signal !RST is denoted by a circuit diagram sign with "!RST: H".

The input end of the inverter circuit 521 is connected to the ground potential. Also, the output end of the inverter circuit 521 is connected to the input end of the inverter circuit 522 and the output end of the inverter circuit 523.

The output end of the inverter circuit 522 is connected to the input end of the inverter circuit 523 and the input end of the inverter circuit 524.

The output end of the inverter circuit 524 is connected to the input end of the inverter circuit 525 and the input end of the inverter circuit 526.

The output end of the inverter circuit 525 is connected to the input end of the inverter circuit 526 and the input end of the inverter circuit 411 included in the register 222.

Figure 19:
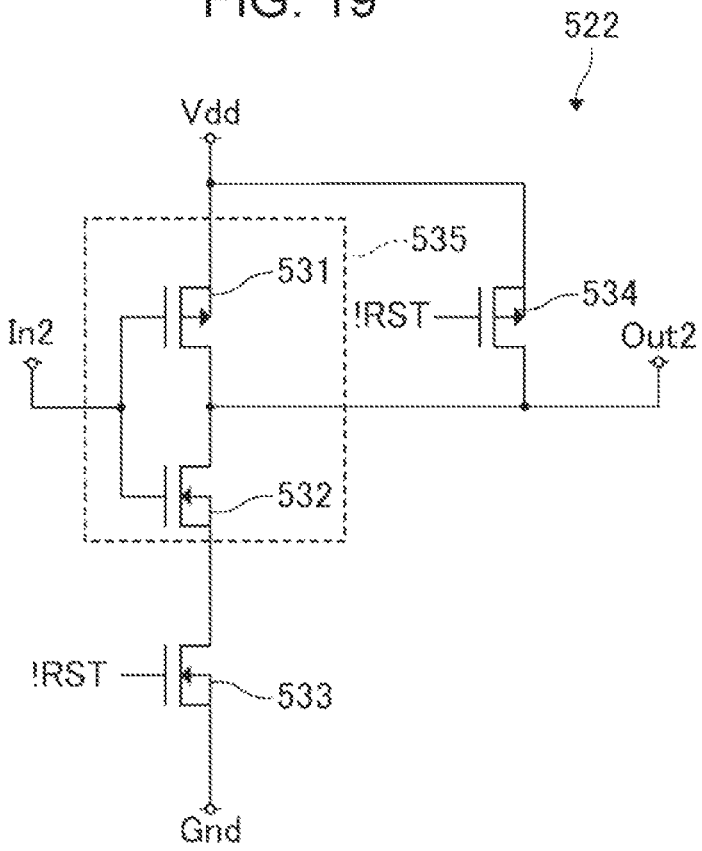
FIG. 19 is an electrical configuration diagram illustrating the configuration of an inverter circuit.

Here, a description will be given of the configuration of the inverter circuit 522 with reference to FIG. 19. FIG. 19 is an electrical configuration diagram illustrating the configuration of the inverter circuit 522.

The inverter circuit 522 includes transistors 531 and 534, which are P-type transistors, and transistors 532 and 533, which are N-type transistors.

The source of the transistor 531 is connected to a terminal Vdd which is supplied with the H-level voltage. Also, the gate of the transistor 531 is commonly connected to the input terminal In2, which is the gate of the transistor 532 and the input end of the inverter circuit 522. Also, the drain of the transistor 531 is commonly connected to the output terminal Out2, which is the drain of the transistor 532 and the output end of the inverter circuit 522. Also, the source of the transistor 532 is connected to the drain of the transistor 533.

In this manner, the transistors 531 and 532 constitute an inverter circuit 535 that inverts the logic level of the data, which is input to the input terminal In2, and outputs the data to the output terminal Out2.

The source of the transistor 533 is connected to the terminal Gnd, which is the ground potential. Also, the reset signal !RST is input to the gate of the transistor 533.

The drain of the transistor 534 is connected to the terminal Vdd, which is supplied with the H-level voltage. Also, the reset signal !RST is input to the gate of the transistor 534. Also, the source of the transistor 534 is connected to the output terminal Out2.

When the L-level reset signal !RST is input to the inverter circuit 522, the transistor 534 becomes ON. Thereby, the H-level voltage, which is supplied to the terminal Vdd via the transistor 534, is output to the output terminal Out2 of the inverter circuit 522.

Also, when the L-level reset signal !RST is input to the inverter circuit 522, the transistor 533 becomes OFF. Thereby, the L-level voltage is not supplied to the source of the transistor 532. That is to say, the inverter circuit 510 does not output the L-level signal regardless of the input signal.

Referring back to FIG. 18, when the clock signal SCK is the H level, the register 226 captures the ground potential data and holds the ground potential data at a node d, to which the output end of the inverter circuit 522 and the input end of the inverter circuit 523 are connected.

Also, when the clock signal SCK is the L level, if the reset signal !RST is input, the inverter circuit 521 does not operate. At this time, the inverter circuit 522 outputs the H-level signal in accordance with the input reset signal !RST and holds the H-level signal at the node d. Also, at this time, the clock signal SCK is the L level, and thus the H level signal held at the node d is also held at a node e, to which the output end of the inverter circuit 525 and the input end of the inverter circuit 411 included in the register 222 are connected.

When the reset circuit 228 stops outputting the reset signal RST, and the clock signal SCK is input to the discharge head 20, the H-level data held at the node e is transferred to the register 222.

As described above, in the second embodiment, in addition to the advantages of the first embodiment, the register selection data dRS is held in the register 226 in accordance with the reset signal RST, and thus it is not necessary to transfer the register selection signal RS from the control unit 10. Accordingly, it becomes possible to reduce wiring lines between control unit 10 and the discharge head 20. Also, the register selection signal RS is not transferred via the wiring lines, and thus it becomes possible to reduce malfunctions due to noise, or the like.

Further, in the second embodiment, when transmission of the print data signal SI is ended, the register selection data dRS held in the register 222 is reset.

Accordingly, it becomes possible to reduce the occurrence of malfunctions caused by holding the data that has occurred from noise, and the like in the plurality of registers 222 constituting the shift register circuit 221.

In the above, the descriptions have been given of the embodiments and the variations. However, the invention is not limited to these embodiments, and it is possible to carry out the invention in various modes without departing from the spirit and scope of the invention. For example, it is possible to suitably combine the above-described embodiments.

The invention includes substantially the same configuration as the configuration (for example, the configuration having the same functions, methods, results, or the configuration having the same objects and effects) described in the embodiments. Also, the invention includes the configuration in which an unessential part in the embodiments is replaced. Also, the invention includes the configuration having the same advantages as the configuration described in the embodiments or the configuration that enables to accomplish the same purpose. Also, the invention includes the configuration in which a publicly known technique is added to the configuration described in the embodiments.

What is claimed is:

1. A liquid discharge apparatus comprising:

a signal line supplied with a print data signal including first data and second data;

a discharge head including a plurality of nozzles including a first nozzle and a second nozzle that discharge liquid in accordance with the print data signal;

a first register that is connected to the signal line, captures the first data corresponding to the first nozzle, and holds the first data;

a second register that is separate from the first register and connected to the signal line, captures the second data corresponding to the second nozzle, and holds the second data; and a register selection circuit that includes a shift register having a third register and a fourth register, wherein the register selection circuit receives register selection data and, based on the register selection data, selects between capturing the first data using the first register and capturing the second data using the second register.

2. The liquid discharge apparatus according to claim 1, wherein when the register selection data is held in the third register, the first register captures the first data, and when the register selection data is held in the fourth register, the second register captures the second data.

3. The liquid discharge apparatus according to claim 2, wherein when supply of the print data signal is stopped, the register selection data is set to be input to the shift register.

4. The liquid discharge apparatus according to claim 2, wherein when supply of the print data signal is stopped, data held in the third register and the fourth register are reset by a reset signal.

5. The liquid discharge apparatus according to claim 1, wherein the plurality of nozzles are disposed at a density of 300 pieces or more per inch, and a number of the nozzles is 600 or more.

6. The liquid discharge apparatus according to claim 1, wherein the discharge head includes a piezoelectric element that causes the plurality of nozzles to discharge the liquid based on the print data signal, an integrated circuit that includes the first register, the second register, and the register selection circuit, and a protection substrate disposed between the piezoelectric element and the integrated circuit, wherein the protection substrate forms a protection space that protects the piezoelectric element.

* * * * *